US009411258B1

(12) United States Patent
Ishii

(10) Patent No.: US 9,411,258 B1
(45) Date of Patent: Aug. 9, 2016

(54) IMAGE FORMING APPARATUS

(71) Applicant: Oki Data Corporation, Tokyo (JP)

(72) Inventor: Takeshi Ishii, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/952,917

(22) Filed: Nov. 25, 2015

(30) Foreign Application Priority Data

Mar. 20, 2015 (JP) ..... 2015-057714

(51) Int. Cl.
*G03G 15/04* (2006.01)
*G03G 15/043* (2006.01)

(52) U.S. Cl.
CPC ..... *G03G 15/043* (2013.01)

(58) Field of Classification Search
CPC ..... G03G 15/043; G03G 15/237; G03G 15/0266; G03G 15/05; G03G 15/14; G03G 15/1665
USPC ..... 399/53, 55, 384
See application file for complete search history.

(56) References Cited

U.S. PATENT DOCUMENTS 7,917,045 B2 * 3/2011 Yagawara ..... G03G 15/0131 399/38
2011/0229173 A1 * 9/2011 Nakayama ..... G03G 15/1605 399/53
2013/0279930 A1 * 10/2013 Uekawa ..... G03G 15/065 399/55

FOREIGN PATENT DOCUMENTS

JP 2004-029681 A 1/2004

* cited by examiner

*Primary Examiner* — Walter L Lindsay, Jr.
*Assistant Examiner* — Jessica L Eley
(74) *Attorney, Agent, or Firm* — Rabin & Berdo, P.C.

(57) ABSTRACT

There is provided an image forming apparatus including: an image supporting member having a first circumferential surface; an exposure section performing exposure of the first circumferential surface and thereby form latent images; a developer supporting member developing the latent images; a feeding member feeding a developer; and a control section controlling, while controlling exposure operation to allow the latent images to be formed side by side on the first circumferential surface, varying timing of a development voltage or both of the development voltage and a supply voltage to allow a portion P1 or both of the portion P1 and a portion P2 to be located within a gap between the latent images. The portion P1 is a portion, in the first circumferential surface, opposed to the developer supporting member. The portion P2 is a portion, in the first circumferential surface, opposed to a portion P3 of the developer supporting member.

12 Claims, 16 Drawing Sheets

230

| DEVELOPMENT VOLTAGE $V_{34}$ AT PRINTING START | CONTINUOUS PRINTING COUNT Nc | | | | | |
|---|---|---|---|---|---|---|
| | $500 \leq Nc < 1000$ | $1000 \leq Nc < 1500$ | $1500 \leq Nc < 2000$ | $2000 \leq Nc < 2500$ | $2500 \leq Nc < 3000$ | $3000 \leq Nc$ |
| $V_{34} < \lvert 180 \rvert V$ | +17 | +34 | +51 | +68 | +85 | +102 |
| $\lvert 180 \rvert V \leq V_{34} < \lvert 230 \rvert V$ | +12 | +24 | +36 | +48 | +60 | +72 |
| $\lvert 230 \rvert V \leq V_{34}$ | +8 | +16 | +24 | +32 | +40 | +48 |

FIG. 6

IMAGE FORMING APPARATUS

CROSS REFERENCE TO RELATED APPLICATIONS

This application claims the benefit of Japanese Priority Patent Application JP2015-057714 filed on Mar. 20, 2015, the entire contents of which are incorporated herein by reference.

BACKGROUND

The present disclosure relates to an electrophotographic image forming apparatus.

In an electrophotographic image forming apparatus, after a photoconductive drum is charged to negative by a charging roller, a negatively-charged part of the photoconductive drum is applied with a light beam, which forms a latent image. The latent image is developed by a developer that is supplied from a developing roller and a feeding roller, and a developer image formed by the development is transferred on paper by a transfer roller.

In the case where the image forming apparatus is a printer forming a color image, it is necessary to strictly control an amount of the developer to be transferred on paper in order to faithfully reproduce the color image. For example, in Japanese Unexamined Patent Application Publication No. 2004-29681, an image forming apparatus is disclosed in which density of a developer of a patch pattern printed on a transfer belt is measured, and density correction of the developer is performed by controlling a process condition, based on density data obtained through the measurement.

SUMMARY

In the image forming apparatus disclosed in Japanese Unexamined Patent Application Publication No. 2004-29681, it is necessary to interrupt normal printing operation in order to perform the density correction of the developer. In a case where printing in which the printing operation is difficult to be interrupted is performed over long time, however, the density correction of the developer may have to be performed during the printing operation. In such a case, density or color tone may be largely varied in a printed image.

It is desirable to provide an image forming apparatus that makes it possible to suppress large variation in density or color tone in a printed image.

An image forming apparatus according to an embodiment of the technology includes: an image supporting member having a first circumferential surface that includes a photoreceptive layer; an exposure section configured to perform exposure of the first circumferential surface and thereby form latent images; a developer supporting member having a second circumferential surface opposed to the first circumferential surface, and configured to develop the latent images with use of a developer; a feeding member having a third circumferential surface opposed to the second circumferential surface, and configured to feed the developer to the developer supporting member; and a control section configured to control, while controlling exposure operation of the exposure section to allow the latent images to be formed side by side at a predetermined interval on the first circumferential surface, varying timing of a development voltage or both of the development voltage and a supply voltage to allow a portion P1 or both of the portion P1 and a portion P2 to be located within a gap between the latent images on the first circumferential surface, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage. As used herein, the term "oppose" and its grammatical variants are intended to encompass not only a separated state but also a contact state between one member and the other member.

An image forming apparatus according to another embodiment of the technology includes: an image supporting member having a first circumferential surface that includes a photoreceptive layer; an exposure section configured to perform exposure of the first circumferential surface and thereby form latent images; a developer supporting member having a second circumferential surface opposed to the first circumferential surface, and configured to develop the latent images with use of a developer; a feeding member having a third circumferential surface opposed to the second circumferential surface, and configured to feed the developer to the developer supporting member; and a control section configured to, in a label printing mode in which printing is performed on rolled paper to which a plurality of labels are attached at a predetermined interval, control varying timing of a development voltage or both of the development voltage and a supply voltage to allow a portion P1 or both of the portion P1 and a portion P2 to be opposed to a gap between the labels on the rolled paper or a portion to be opposed to the gap between the labels, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage. As used herein, the term "oppose" and its grammatical variants are intended to encompass not only a separated state but also a contact state between one member and the other member.

According to the image forming apparatuses of the respective embodiments of the disclosure, it is possible to suppress large variation in density and color tone in a printed image.

It is to be understood that both the foregoing general description and the following detailed description are exemplary, and are intended to provide further explanation of the technology as claimed. Also, effects of the invention are not limited to those described above. Effects achieved by the invention may be those that are different from the above-described effects, or may include other effects in addition to those described above.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 6 is a diagram illustrating an example of a correction table.

DETAILED DESCRIPTION

Figure 1:
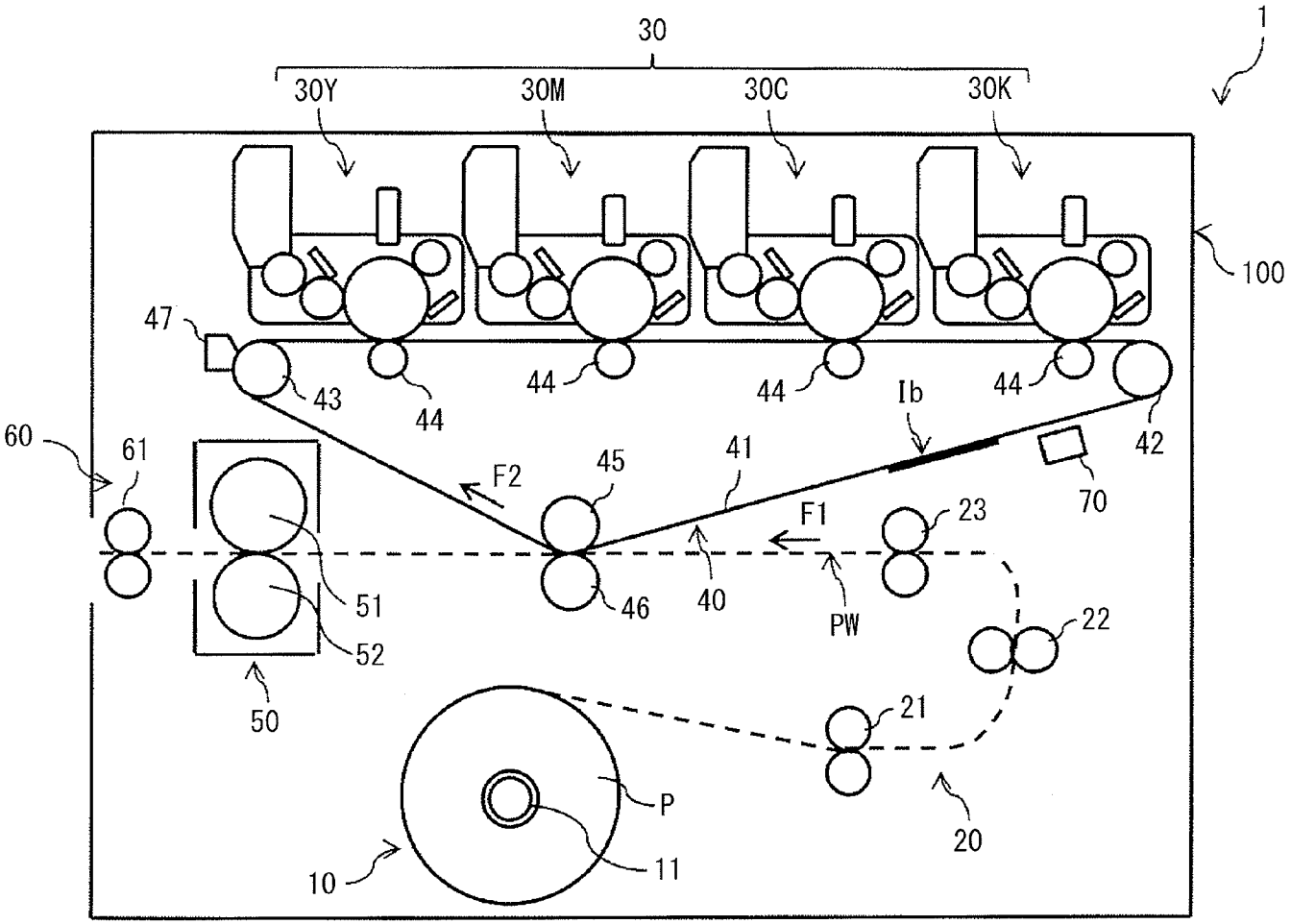
FIG. 1 is a schematic diagram illustrating an outline configuration example of an image forming apparatus according to an embodiment of the disclosure.

Hereinafter, some embodiments of the disclosure are described in detail with reference to drawings. The following description is merely a specific example of the disclosure, and the disclosure is not limited to the embodiment described below. Positions, sizes, and size ratios of respective components illustrated in the drawings of the disclosure are not limited to those illustrated. Note that description is given in the following order.

1. Embodiment

An example in which a voltage-varying timing is controlled with use of user input 2. Modifications Modification 1: an example in which voltage-varying timing is controlled with use of a detection result Modification 2: an example in which voltage-varying timing is controlled with use of an exposure control signal Modification 3: an example in which printing is performed by direct transfer method Modification 4: various modifications

1. Embodiment

[Configuration]

Figure 2:
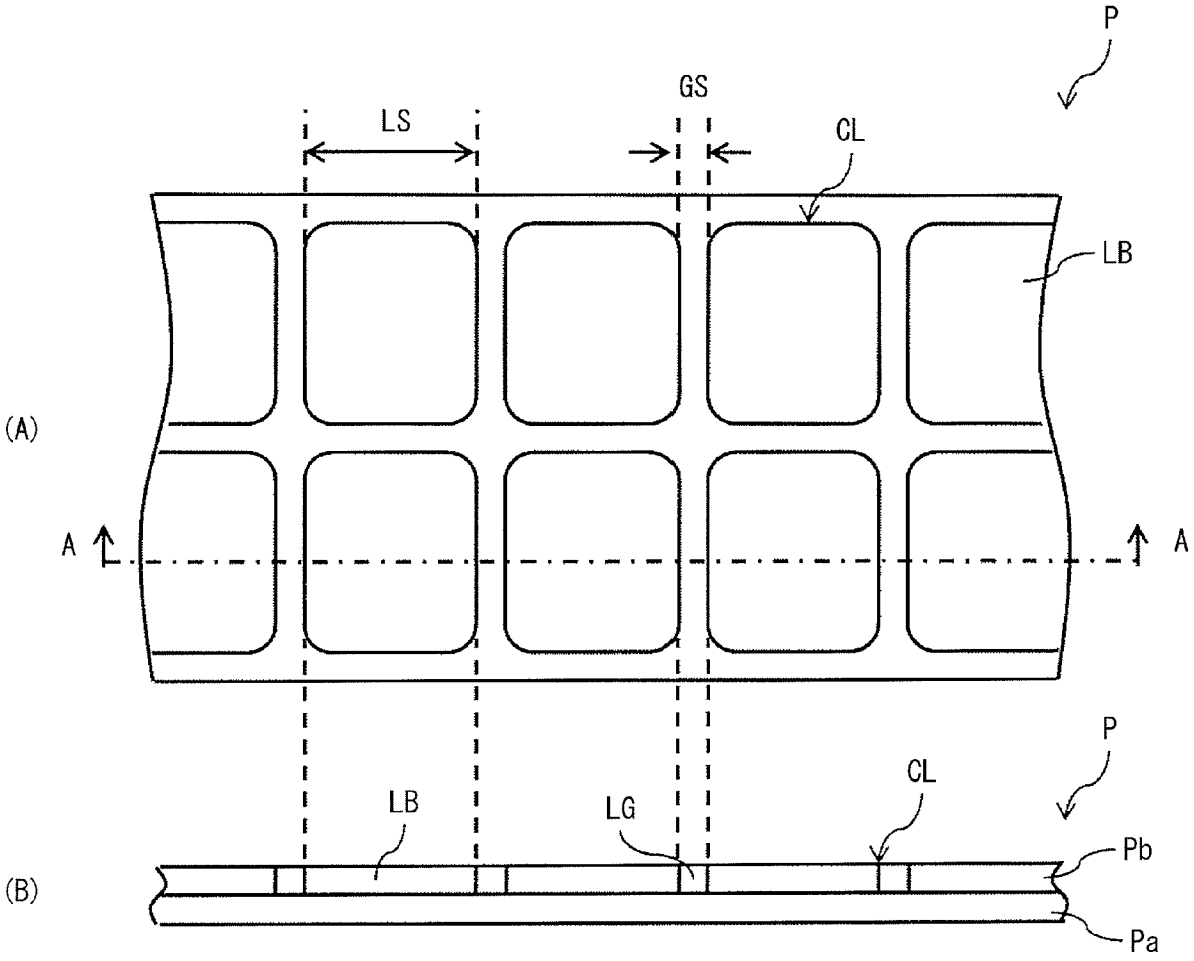
FIG. 2 is a diagram illustrating a medium illustrated in FIG. 1, where (A) is a schematic diagram illustrating a plan structure example of the medium, and (B) is a sectional diagram illustrating a sectional structure example taken along a line A-A of (A).

FIG. 1 schematically illustrates an outline configuration example of an image forming apparatus 1 according to an embodiment of the disclosure. The image forming apparatus 1 may be a printer that forms a color image on a medium P with use of an electrophotographic method. The medium P corresponds to a specific but non-limiting example of "medium" in the disclosure. (A) of FIG. 2 illustrates an example of a plan structure of the medium P. (B) of FIG. 2 illustrates an example of a sectional structure of the medium P taken along a line A-A in (A) of FIG. 2.

For example, the medium P may be rolled paper including a long rolled mount Pa and long label paper Pb that are overlaid with each other. The rolled mount Pa supports the label paper Pb. The label paper Pb may include an adhesive layer on a surface close to the rolled mount Pa. The label paper Pb may include a plurality of labels LB and a gap LG between labels that is formed around the labels LB. Each label LB may be cut and separated from the gap LG between labels. In the label paper Pb, a line where each label LB is cut and separated from the gap LG between labels is referred to as a cut line CL. The plurality of labels LB may be arranged in a longitudinal direction of the rolled mount Pa with an interval each having a label gap size GS. For example, the medium P may be rolled paper on which the plurality of labels LB are attached at a predetermined interval. The medium P may include, on a surface of the long rolled mount Pa, the plurality of labels LB that are arranged in the longitudinal direction of the rolled mount Pa with an interval each having a label gap size Gs.

The image forming apparatus 1 may include a medium container 10, a medium conveyor (paper conveyor) 20, an image forming section 30, a transfer section 40, a fixing section 50, a discharge section 60, and a density sensor 70. The medium container 10, the medium conveyor 20, the image forming section 30, the transfer section 40, the fixing section 50, the discharge section 60, and the density sensor 70 may be provided inside a housing 100.

As used herein, a path on which the medium P is conveyed is referred to as a conveying path. In the conveying path PW, a direction toward the medium container 10 as viewed from any component or a position closer to the medium container 10 is referred to as "upstream in the conveying path PW". In the conveying path PW, a direction opposite to the direction toward the medium container 10 as viewed from any component or a position further apart from the medium container 10 is referred to as "downstream in the conveying path PW". In the conveying path PW, a direction in which the medium P travels (namely, a direction from the upstream toward the downstream in the conveying path PW) is referred to as a conveying direction F1.

[Configuration of Medium Container 10]

The medium container 10 may contain the medium P. For example, the medium container 10 may include a holding shaft 11 that holds the medium P rotatably.

[Configuration of Medium Conveyor 20]

The medium conveyor 20 may deliver the medium P from the medium container 10 and may prevent the medium P from skewing, and may convey the medium P to the transfer section 40 along the conveying path PW. The medium conveyor 20 may be located downstream of the medium container 10 in the conveying path PW. For example, the medium conveyor 20 may include a delivering roller pair 21, a conveying roller pair 22, and a resist roller pair 23. The delivering roller pair 21, the conveying roller pair 22, and the resist roller pair 23 may be disposed in this order along the conveying direction F1.

The delivering roller pair 21 may feed the medium P to the conveying path PW. The delivering roller pair 21 may rotate in a direction in which the medium P is delivered to the conveying path PW under the control of a process control section 300 described later. The conveying roller pair 22 may convey the medium P in the conveying direction F1 along the conveying path PW. The conveying roller pair 22 may rotate in a direction in which the medium P is conveyed in the conveying direction F1 under the control of the process control section 300. The resist roller pair 23 may prevent the medium P from skewing. The resist roller pair 23 may rotate in a direction in which the medium P is conveyed in the conveying direction F1 and may prevent the medium P from skewing under the control of the process control section 300.

[Configuration of Image Forming Section 30]

The image forming section 30 may form an image (a toner image) on a circumferential surface 31A of a photoconductive drum 31 described later. The image forming section 30 may include, for example, four image forming units. For example, as illustrated in FIG. 1, the four image forming units may be image forming units 30Y, 30M, 30C, and 30K.

Figure 3:
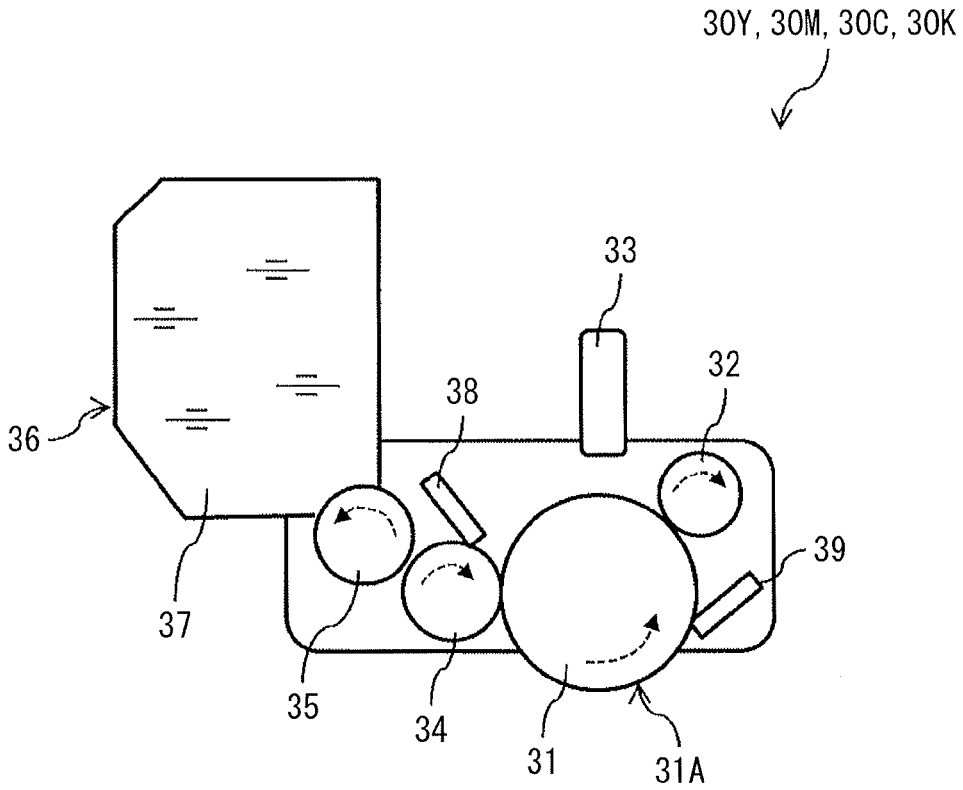
FIG. 3 is a schematic diagram illustrating an outline configuration example of an image forming unit in FIG. 1.

FIG. 3 schematically illustrates an outline configuration example of any of the image forming units 30Y, 30M, 30C, and 30K. Each of the image forming units 30Y, 30M, 30C, and 30K may develop an electrostatic latent image Ia on the circumferential surface 31A of the photoconductive drum 31 and may form a toner image Ib of corresponding color, with use of toner 37 of corresponding color. The toner 37 may include a yellow toner, a magenta toner, a cyan toner, and a black toner corresponding to the image forming units 30Y, 30M, 30C, and 30K, respectively. The toner 37 corresponds to a specific but non-limiting example of "developer" in the disclosure. The electrostatic latent image Ia corresponds to a specific but non-limiting example of "latent image" in the disclosure. The image forming units 30Y, 30M, 30C, and 30K may be disposed in this order, for example, toward a rotation direction F2 of a transfer belt 41 described later. The image forming units 30Y, 30M, 30C, and 30K may include components identical to one another.

Each of the image forming units 30Y, 30M, 30C, and 30K may include, for example, the photoconductive drum 31, a charging roller 32, a light emitting diode (LED) head 33, a developing roller 34, a feeding roller 35, a cartridge 36, a regulation blade 38, and a cleaning blade 39. The cartridge 36 may be filled with the toner 37. The photoconductive drum 31 corresponds to a specific but non-limiting example of "image supporting member" in the disclosure. The LED head 33 corresponds to a specific but non-limiting example of "exposure section" in the disclosure. The developing roller 34 corresponds to a specific but non-limiting example of "developer supporting member" in the disclosure. The feeding roller 35 corresponds to a specific but non-limiting example of "feeding member" in the disclosure.

The photoconductive drum 31 includes the circumferential surface 31A that includes a photoreceptive layer (for example, an organic photoreceptor), and may be a columnar member adapted to support the electrostatic latent image Ia on the circumferential surface 31A. Specifically, the photoconductive drum 31 may include an electrically-conductive support and a photoconductive layer that covers an outer periphery (a surface) thereof. The conductive support may be formed of, for example, a metal pipe made of aluminum. The photoconductive layer may include a structure in which, for example, a charge generation layer and a charge transport layer are stacked in order. The photoconductive drum 31 may rotate in a direction in which the transfer belt 41 rotates in the rotation direction F2 at a predetermined circumferential velocity under the control of the process control section 300.

The charging roller 32 may be a member (charging member) charging the circumferential surface 31A of the photoconductive drum 31. The charging roller 32 may be so disposed as to be opposed to the circumferential surface 31A of the photoconductive drum 31, and may be disposed to face the circumferential surface 31A. The charging roller 32 may include, for example, a metal shaft made of stainless steel and a semiconductive elastic layer (for example, a semiconductive epichlorohydrin rubber layer) that covers an outer periphery (a surface) thereof. The charging roller 32 may rotate in a direction opposite to the rotation direction of the photoconductive drum 31 by, for example, drive transmission from the photoconductive drum 31. The charging member of the charging roller 32 may be applied with a charged voltage from the process control section 300.

The LED head 33 exposes a charged region of the circumferential surface 31A that has been charged by the charging roller 32 under the control of the process control section 300, thereby forming the electrostatic latent image Ia in the charged region of the circumferential surface 31A. The LED head 33 may be disposed to face the circumferential surface 31A at a position downstream of the charging roller 32 in the rotation direction of the photoconductive drum 31. The LED head 33 may include a plurality of LED emitting sections that are arranged in a width direction of the photoconductive drum 31. Each of the LED emitting sections may include, for example, a light source emitting irradiation light, such as a light emitting diode, and a lens array that causes the irradiation light to be collected on the surface of the photoconductive drum 31.

The developing roller 34 may be a member that supports the toner 37 on the surface thereof, and develops the electrostatic latent image Ia with use of the toner 37 to form a toner image Ib. The developing roller 34 includes a circumferential surface 34A opposed to the circumferential surface 31A of the photoconductive drum 31, and is disposed to face the circumferential surface 31A at a position downstream of the LED head 33 in the rotation direction of the photoconductive drum 31. The circumferential surface 34A corresponds to a specific but non-limiting example of "second circumferential surface" in the disclosure. The developing roller 34 may include, for example, a metal shaft made of stainless steel, and a semiconductive elastic layer (for example, a semiconductive urethane rubber layer) covering an outer periphery (a surface) thereof. The developing roller 34 may rotate in a direction opposite to the rotation direction of the photoconductive drum 31 by, for example, drive transmission from the photoconductive drum 31. The surface of the developing roller 34 may be applied with a development voltage $V_{34}$ from the process control section 300.

The feeding roller 35 is a member (a feeding member) feeding the toner 37 to the developing roller 34, and includes a circumferential surface 35A opposed to the circumferential surface 34A of the developing roller 34. The circumferential surface 35A corresponds to a specific but non-limiting example of "third circumferential surface" in the disclosure. The feeding roller 35 may include, for example, a metal shaft made of stainless steel and a foamed elastic layer (for example, a silicone rubber layer) covering an outer periphery (a surface) thereof. The feeding roller 35 may rotate in a direction opposite to the rotation direction of the developing roller 34 by, for example, drive transmission from the developing roller 34. The surface of the feeding roller 35 may be applied with a supply voltage $V_{35}$ from the process control section 300. The feeding roller 35 may generate an electric field between the feeding roller 35 and the developing roller 34 with use of the supply voltage $V_{35}$ applied on the surface of the feeding roller 35, and may feed the toner 37 from the feeding roller 35 to the developing roller 34 through the function of the electric field.

The cartridge 36 may be a container in which the above-described toner 37 of corresponding one of the colors is contained. The yellow toner 37 may be contained in the cartridge 36 of the image forming unit 30Y. The magenta toner 37 may be contained in the cartridge 36 of the image forming unit 30M. The cyan toner 37 may be contained in the cartridge 36 of the image forming unit 30C. The black toner 37 may be contained in the cartridge 36 of the image forming unit 30K. The toner 37 may be, for example, a non-magnetic one-component developer.

The regulation blade 38 may regulate a layer thickness of the toner 37 supported on the surface of the developing roller 34. The regulation blade 38 may be formed of, for example, a steel use stainless (SUS) thin plate. The regulation blade 38 may be disposed to allow a tip thereof to be pressed against the developing roller 34. The regulation blade 38 may frictionally charge the toner 37 on the surface of the developing roller 34 and may regulate the layer thickness of the toner 37. The cleaning blade 39 may scrape the toner 37 remained on the surface of the photoconductive drum 31. The cleaning blade 39 may be formed of, for example, a flexible rubber material or a flexible plastic material.

[Configuration of Transfer Section 40]

The transfer section 40 may electrostatically transfer the toner image Ib that has been formed on the circumferential surface 31A of the photoconductive drum 31, on the medium P conveyed from the medium conveyor 20. The transfer section 40 may include, for example, the transfer belt 41, a driving roller 42, a tension roller 43, a plurality of primary transfer rollers 44, a counter roller 45, a secondary transfer roller 46, and a cleaning member 47. The driving roller 42 may drive the transfer belt 41, and the tension roller 43 may serve as a driven roller. The transfer section 40 may be a mechanism sequentially transferring the toner images Ib formed by the respective image forming units 30Y, 30M, 30C, and 30K on the surface of the transfer belt 41, and then transferring the toner images Ib formed on the transfer belt 41 on the medium P conveyed from the medium conveyor 20.

The transfer belt 41 may be an endless elastic belt formed of a resin material such as a polyimide resin. The transfer belt 41 may be stretched and rotatably supported by the driving roller 42, the tension roller 43, and the counter roller 45. The driving roller 42 may circularly rotate the transfer belt 41 in the rotation direction F2 under the control of the process control section 300. The tension roller 43 may adjust tension to be applied to the transfer belt 41 with use of biasing force by a biasing member. The tension roller 43 may rotate in the direction same as the rotation direction of the driving roller 42.

The primary transfer rollers 44 may be assigned with the respective image forming units 30Y, 30M, 30C, and 30K. Each of the primary transfer rollers 44 may electrostatically transfer, on the transfer belt 41, an image formed on the circumferential surface 31A of the photoconductive drum 31. Each of the primary transfer rollers 44 may be opposed to an inner circumferential surface of the transfer belt 41, and may be disposed to face the corresponding photoconductive drum 31. Each of the primary transfer rollers 44 may be formed of, for example, a metal shaft covered with an electrically-conductive elastic material. The surface of each of the primary transfer rollers 44 may be applied with a primary transfer voltage from the process control section 300.

The counter roller 45 and the secondary transfer roller 46 may be disposed to face each other with the transfer belt 41 in between. The secondary transfer roller 46 may electrostatically transfer the toner image Ib having been formed on the transfer belt 41 on the medium P conveyed through the conveying path PW. The secondary transfer roller 46 may include, for example, a metal core and an elastic layer such as a foamed rubber layer that is so formed as to be wound around the outer circumferential surface of the core. The counter roller 45 may rotate in a direction in which the transfer belt 41 rotates in the rotation direction F2 under the control of the process control section 300. The surface of the secondary transfer roller 46 may be applied with a secondary transfer voltage from the process control section 300.

The cleaning member 47 may be disposed downstream of the secondary transfer roller 46 and upstream of an uppermost image forming unit (the image forming unit 30Y) in the rotation direction F2 of the transfer belt 41. The cleaning member 47 may scrape the toner 37 remained on the surface of the transfer belt 41. The cleaning member 47 may be formed of, for example, a flexible rubber material or a flexible plastic material.

[Configuration of Fixing Section 50]

The fixing section 50 may fixe the toner image Ib on the medium P at predetermined temperature. The fixing section 50 may apply heat and pressure to the toner image Ib transferred on the medium P that has passed through the transfer section 40, thereby fixing the toner image Ib on the medium P. The fixing section 50 may be disposed downstream of the transfer section 40 in the conveying path PW. The fixing section 50 may include, for example, an upper roller 51 and a lower roller 52.

The upper roller 51 may include a heat source, and may function as a heating roller applying heat to the toner image Ib on the medium P. The heat source may be a heater such as a halogen lamp inside the upper roller 51. The upper roller 51 may rotate in a direction in which the medium P is conveyed in the conveying direction F1 under the control of the process control section 300. The heat source in the upper roller 51 may control the temperature of the surface of the upper roller 51 under the control of the process control section 300. The lower roller 52 may be disposed to face the upper roller 51 such that a pressure contact part is formed between the lower roller 52 and the upper roller 51, and may function as a pressure roller applying pressure to the toner image Ib on the medium P. The lower roller 52 may include a surface layer formed of an elastic material.

[Configuration of Discharge Section 60]

The discharge section 60 may discharge the medium P on which the toner image Ib has been fixed by the fixing section 50, to the outside. The discharge section 60 may be disposed downstream of the fixing section 50 in the conveying path PW. The discharge section 60 may include, for example, a conveying roller pair 61. The conveying roller pair 61 may discharge the medium P to the outside through the conveying path PW, and may stock the medium P in an outside stacker, for example. The conveying roller pair 61 may rotate in a direction in which the medium P is conveyed in the conveying direction F1 under the control of the process control section 300.

[Configuration of Density Sensor 70]

The density sensor 70 may detect density of a non-printing-use toner image Ib on the transfer belt 41. "Non-printing-use" refers to the toner image Ib that is not intended to be printed on the medium P. The density sensor 70 may detect density of the non-printing-use toner image Ib on the transfer belt 41 before printing start under the control of the controller 200. "Printing start" refers to time at which printing of a printing-use toner image that is formed through development by the developing roller 34 on the medium P is started. "Printing-use" refers to the toner image Ib that is intended to be printed on the medium P.

The density sensor 70 may include, for example, a light emitting diode (LED) and a photoreceptor diode. The light emitting diode may apply light to the non-printing-use toner image Ib on the transfer belt 41. The photoreceptor diode may receive light (reflected light) that has been reflected by the non-printing-use toner image Ib on the transfer belt 41, out of the light emitted from the light emitting diode. A detection signal outputted from the photoreceptor diode may relate to intensity of the reflected light that is correlated with the density of the non-printing-use toner image Ib. The density sensor 70 may drive the light emitting diode and the photoreceptor diode, for example, based on a control signal received from the controller 200. The density sensor 70 may include a drive circuit providing the controller 200 with the detection signal outputted from the photoreceptor diode. The density sensor 70 may process the detection signal outputted from the photoreceptor diode to generate density data of the non-printing-use toner image Ib, thereby outputting the generated density data. The density sensor 70 may be disposed at a position facing the transfer belt 41. For example, the density sensor 70 may be disposed downstream of the primary transfer roller 44 and upstream of the primary transfer roller 46 in the rotation direction F2 of the transfer belt 41.

[Control Mechanism]

Figure 4:
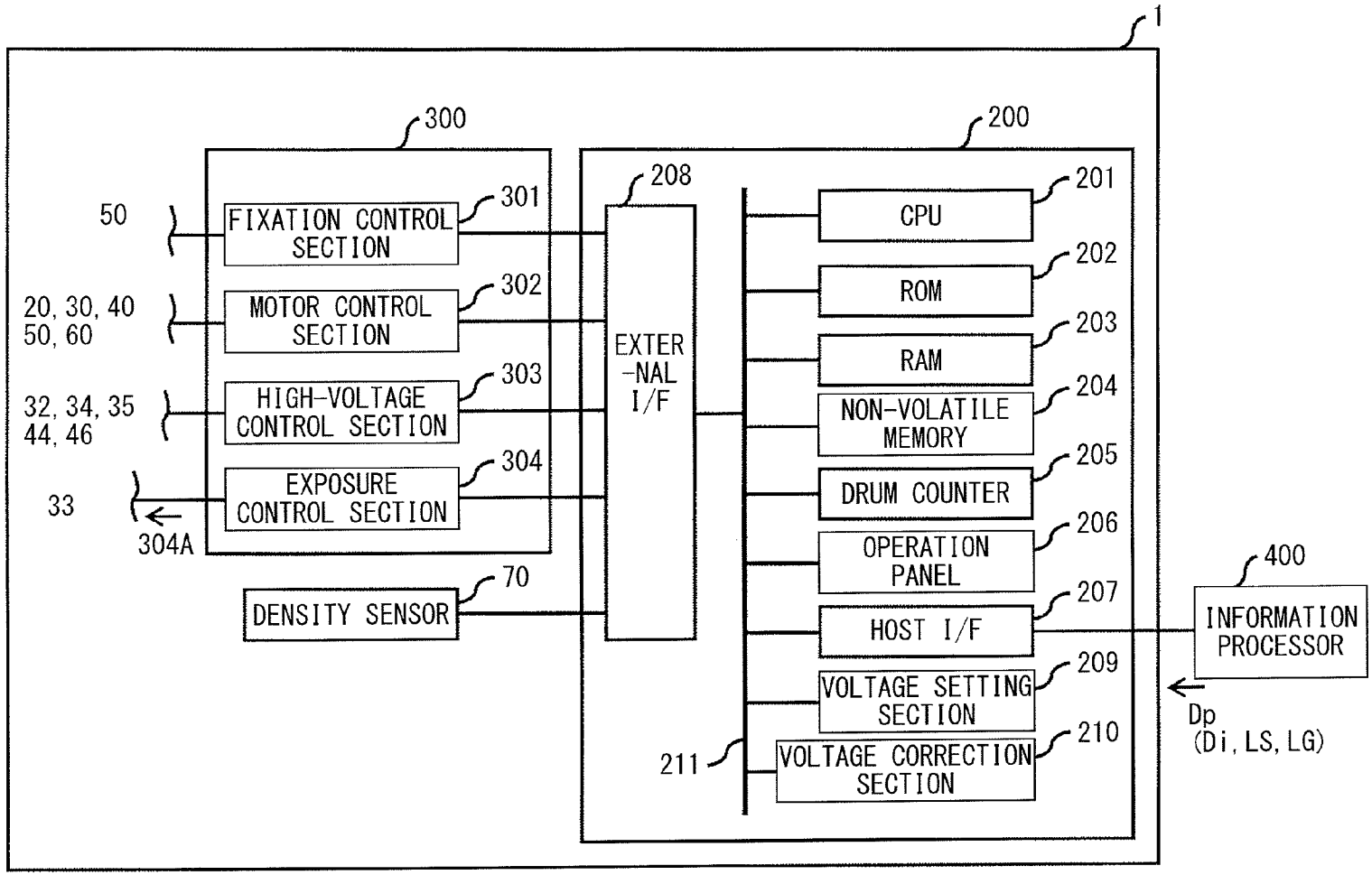
FIG. 4 is a schematic diagram illustrating an example of a control mechanism of the image forming apparatus in FIG. 1.

A control mechanism of the image forming apparatus 1 is described with reference to FIG. 4 in addition to FIG. 1. FIG. 4 is a block diagram illustrating an example of the control mechanism of the image forming apparatus 1.

The image forming apparatus 1 may include, for example, the controller 200 and the process control section 300 as the control mechanism. The controller 200 may control the medium container 10, the medium conveyor 20, the image forming section 30, the transfer section 40, the fixing section 50, and the discharge section 60 through the process control section 300, based on, for example, print data Dp received from an information processor 400. The process control section 300 may control the medium container 10, the medium conveyor 20, the image forming section 30, the transfer section 40, the fixing section 50, and the discharge section 60, based on the control signal received from the controller 200.

The print data Dp may include at least image data Di. The print data Dp may include a label size LS and the label gap size GS in addition to the image data Di. The image data Di corresponds to a specific but non-limiting example of "image data" in the disclosure. The label size LS corresponds to a specific but non-limiting example of "label size" in the disclosure. The label gap size GS corresponds to a specific but non-limiting example of "label gap size" in the disclosure.

The controller 200 may include, for example, a CPU 201, a ROM 202, a RAM 203, and a non-volatile memory 204. The ROM 202 may be a memory holding a control program used to operate the image forming apparatus 1. For example, the CPU 201 may control various components in the image forming apparatus 1 through an internal bus 211. The CPU 201 may control printing operation of the image forming apparatus 1, based on, for example, the control program read from the ROM 202 and the print data $D_P$ received from the outside. The RAM 203 may be a memory holding work necessary for operation of the image forming apparatus 1. The non-volatile memory 204 may hold, for example, a voltage setting expression 220, a target value Dg, a setting value $V_{34S}$, and a setting value $V_{35S}$.

Figure 5:
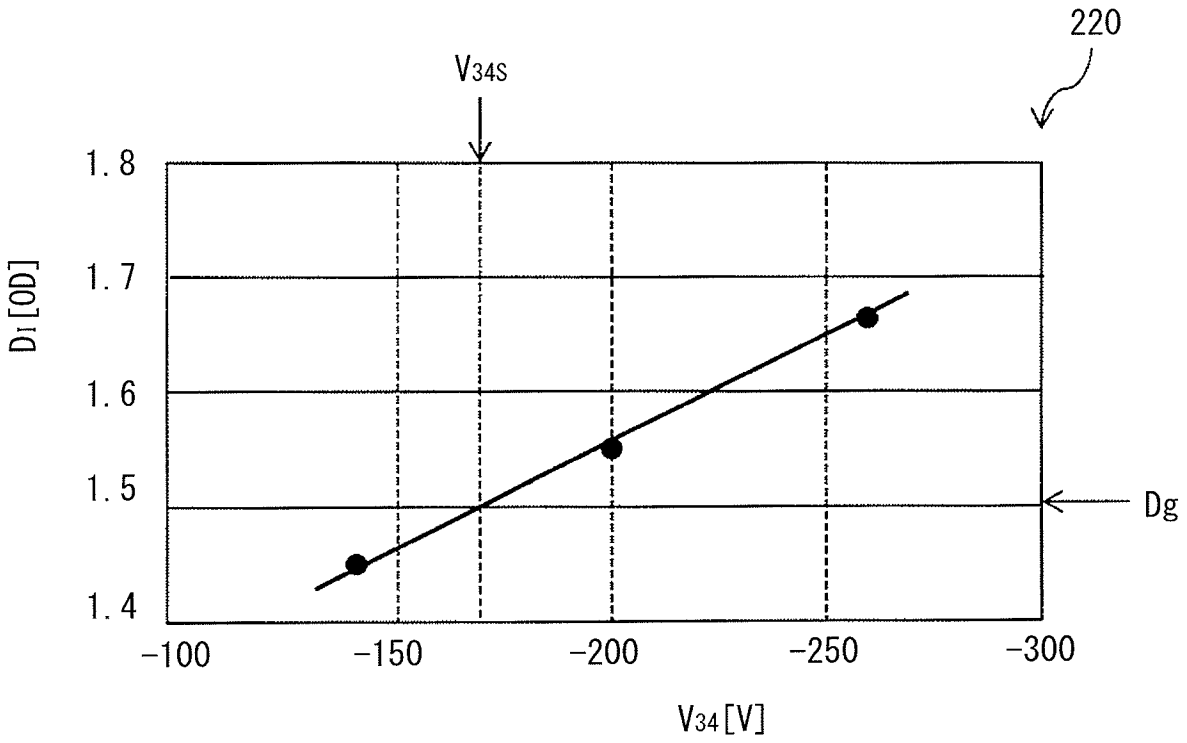
FIG. 5 is a graph illustrating an example of a voltage setting expression.

The voltage setting expression 220 is described. FIG. 5 is a graph illustrating an example of the voltage setting expression 220. The voltage setting expression 220 may show an example of relationship between the development voltage $V_{34}$ and the image density $D_1$. In FIG. 5, a potential difference between the development voltage $V_{34}$ and the supply voltage $V_{35}$ may be fixed. The image density $D_I$ may indicate intensity of reflected light of the toner image Ib on the transfer belt 41 with use of OD value that is an index of optical density. As illustrated in FIG. 5, the development voltage $V_{34}$ may be substantially proportional to the image density $D_I$ within a limited range. Thus, adjusting the development voltage $V_{34}$ makes it possible to adjust the image density $D_I$ to the target value Dg. For example, in the example of FIG. 5, when the target value Dg of the image density $D_I$ is adjusted to the OD value of 1.5, −170 V is set to the setting value $V_{34S}$ of the development voltage $V_{34}$. At this time, for example, −270 V may be set to the setting value $V_{35S}$ of the supply voltage $V_{35}$. Note that specific derivation and utilization of the voltage setting expression 220 are described in detail later.

The non-volatile memory 204 may hold, for example, a correction table 230 or a plurality of thresholds Nc_th that are different from one another. FIG. 6 illustrates an example of the correction table 230. The correction table 230 may include correction values of the development voltage $V_{34}$ set for each range of the development voltage $V_{34}$ at the printing start. In the correction table 230, the range of continuous printing count Nc may be divided into a plurality of ranges R1 by the plurality of thresholds Nc_th. For example, the range of the continuous printing count Nc may be divided into six ranges R1 by five thresholds Nc_th. The six ranges R1 may be, for example, "a range from 500 counts or more to less than 1000 counts (a range R1(1))", "a range from 1000 counts or more to less than 1500 counts (a range R1(2))", "a range from 1500 counts or more to less than 2000 counts (a range R1(3))", "a range from 2000 counts or more to less than 2500 counts (a range R1(4))", "a range from 2500 counts or more to less than 3000 counts (a range R1(5))", and "a range of 3000 counts or more (a range R1(6))".

In the correction table 230, the set range of the development voltage $V_{34}$ may be further divided into a plurality of ranges R2. For example, the set range of the development voltage $V_{34}$ may be divided into three ranges R2. The three ranges R2 may be, for example, "a range where $|V_{34}|$ is lower than 180 V (a range R2(1))", "a range where $|V_{34}|$ is equal to or higher than 180 V and lower than 230 V (a range R2(2))", and "a range where $|V_{34}|$ is equal to or higher than 230 V (a range R2(3))".

In the correction table 230, the correction value of the development voltage $V_{34}$ may be assigned to each of the divided ranges R1. For example, in the range R2(1), +17 V may be assigned to the range R1(1) as the correction value of the development voltage $V_{34}$. For example, in the range R2(1), +34 V may be assigned to the range R1(2) as the correction value of the development voltage $V_{34}$. For example, in the range R2(1), +51 V may be assigned to the range R1(3) as the correction value of the development voltage $V_{34}$. For example, in the range R2(1), +68 V may be assigned to the range R1(4) as the correction value of the development voltage $V_{34}$. For example, in the range R2(1), +85 V may be assigned to the range R1(5) as the correction value of the development voltage $V_{34}$. For example, in the range R2(1), +102 V may be assigned to the range R1(6) as the correction value of the development voltage $V_{34}$.

In the correction table 230, the correction value of the development voltage $V_{34}$ may be further assigned to each of the divided ranges R2. For example, in the range R1(1), +17 V may be assigned to the range R2(1) as the correction value of the development voltage $V_{34}$. For example, in the range R1(1), +12 V may be assigned to the range R2(2) as the correction value of the development voltage $V_{34}$. For example, in the range R1(1), +8 V may be assigned to the range R2(3) as the correction value of the development voltage $V_{34}$.

In each range R1 of the correction table 230, the correction value of the development voltage $V_{34}$ may be varied depending on the range R2. Further, in each range R1 of the correction table 230, an absolute value of the correction value of the development voltage $V_{34}$ may be increased as the range R2 becomes lower. For example, in the range R1(1), +8 V may be assigned to the range R2(3) as the correction value of the development voltage $V_{34}$. For example, in the range R1(1), +12 V (>+8 V) may be assigned to the range R2(2) as the correction value of the development voltage $V_{34}$. For example, in the range R1(1), +17 V (>+12 V) may be assigned to the range R2(1) as the correction value of the development voltage $V_{34}$.

Figure 7:
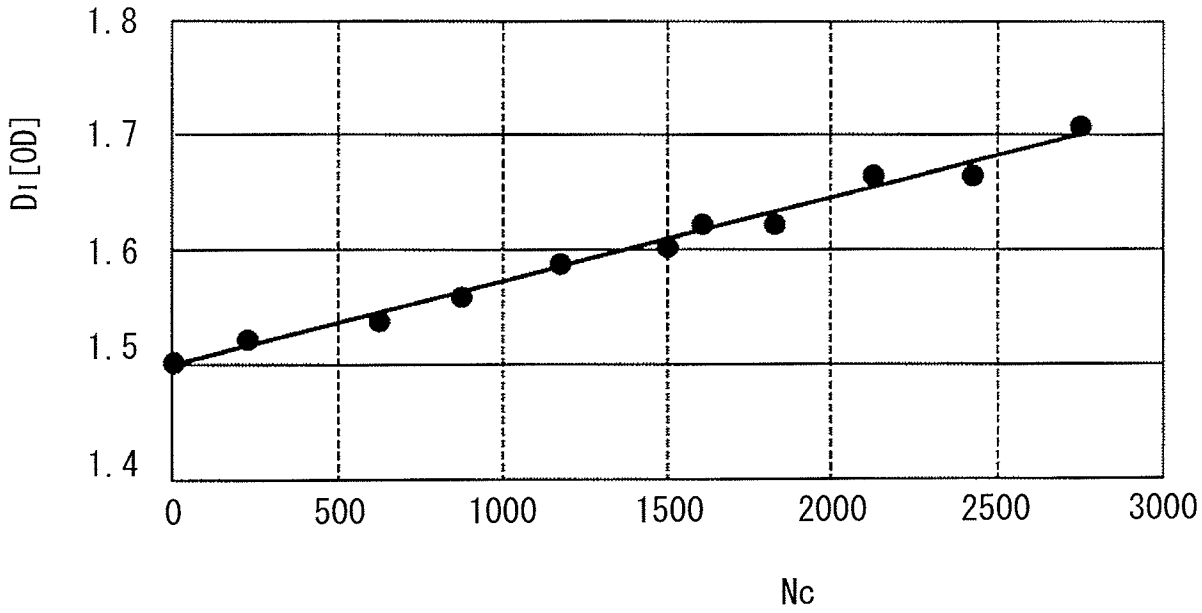
FIG. 7 is a diagram illustrating an example of variation in image density by continuous printing.

One significance of the correction table 230 is described. FIG. 7 illustrates an example of variation in the image density $D_I$ by the continuous printing. As can be seen from FIG. 7 that the image density $D_I$ is increased with an increase in the continuous printing count Nc. For example, in a case where the continuous printing count Nc is increased from 0 count to 1600 counts as a result of the continuous printing, the OD value is increased from 1.50 to 1.62. For example, when 1000 pieces of the labels with the same image pattern are printed while the continuous printing count Nc is increased from 0 count to 1600 counts, the color of the image is gradually varied, which results in remarkable color tone difference between a first label and 1000th label. Accordingly, a method may be contemplated to adjust the process condition (such as the development voltage $V_{34}$) even during the continuous printing to minimize variation in the image density $D_I$. The tolerance of difference in color tone depends on, for example, user and the purpose of use. However, to avoid difference in color tone remarkable visually, the difference of the image density $D_I$ may be preferably within 0.05 in OD value.

To adjust the image density $D_I$ to the target value, a method may be contemplated to adjust the development voltage $V_{34}$ with use of the above-described voltage setting expression 220. As will be described later, this, on the other hand, requires interruption of the continuous printing in order to use the above-described voltage setting expression 220. However, when the continuous printing count NC during the continuous printing is within each range R1 of the correction table 230, it is possible to adjust the development voltage $V_{34}$ with use of the correction table 230 instead of the above-described voltage setting expression 220. In other words, using the correction table 230 makes it possible to adjust the development voltage $V_{34}$ without interrupting the continuous printing. A specific method of utilizing the correction table 230 is described in detail later.

The non-volatile memory 204 may hold, for example, a threshold Nt_th. The threshold Nt_th may be larger than the threshold Nc_th. For example, a result detected by a drum counter 205 described later, the continuous printing count Nc, and an accumulated count Nt described later may be held by the non-volatile memory 204. The result detected by the drum counter 205 may include, for example, the number of rotations of the photoconductive drum 31, or physical quantity correlated with the number of rotations of the photoconductive drum 31. The threshold Nt_th, the number of rotations of the photoconductive drum 31, the physical quantity correlated with the number of rotations of the photoconductive drum 31, the continuous printing count Nc, and the accumulated count Nt are described in detail later.

Next, other configurations in the controller 200 are described. The controller 200 may further include, for example, the drum counter 205, an operation panel 206, a host I/F 207, an external I/F 208, a voltage setting section 209, and a voltage correction section 210.

The drum counter 205 may detect the number of rotations of the photoconductive drum 31 or the physical quantity correlated with the number of rotations of the photoconductive drum 31. The drum counter 205 may perform counting of the continuous printing count Nc and the accumulated count Nt during a predetermined period. The drum counter 205 may store the continuous printing count Nc and the accumulated count Nt that are obtained by the counting, in the non-volatile memory 204. The initial values of the continuous printing count Nc and the accumulated count Nt may be, for example, zero. The drum counter 205 may reset the continuous printing count NC stored in the non-volatile memory 204 to the initial value at the time when the printing is stopped or started. The drum counter 205 may reset the accumulated count Nt stored in the non-volatile memory 204 to the initial value at the time when density correction described later is performed.

Here, the predetermined period refers to a period from a time point when the setting value $V_{34S}$ set by a high-voltage control section 303 described later is applied as the development voltage $V_{34}$ to the developing roller 34 to a time point when the printing is stopped. The continuous printing count Nc and the accumulated count Nt each refer to, for example, the number of pulses of a drive pulse signal outputted to a motor from a motor control section 302 when the motor control section 302 pulse-controls the motor that rotates the photoconductive drum 31. At this time, the continuous printing count Nc and the accumulated count Nt may be specific but non-limiting examples of the physical quantity correlated with the number of rotations of the photoconductive drum 31. Further, at this time, the drum counter 205 may count the number of pulses of the above-described drive pulse signal. Note that the continuous printing count Nc and the accumulated count Nt may be different from the number of pulses of the above-described drive pulse signal as long as being the number of rotations of the photoconductive drum 31 or the physical quantities correlated with the rotation number of the photoconductive drum 31.

The continuous printing count Nc and the accumulated count Nt each may be incremented by one, for example, every time the photoconductive drum 31 rotates once. At this time, the continuous printing count Nc and the accumulated count Nt each may be equal to the number of rotations of the photoconductive drum 31. At this time, for example, the drum counter 205 may detect, once, a marker provided at a predetermined position of the photoconductive drum 31 every time the photoconductive drum 31 rotates once, and may increment each of the continuous printing count Nc and the accumulated count Nt by one every time detecting the marker.

Note that the continuous printing count Nc illustrated in the drawings may be incremented by one every time the photoconductive drum 31 rotates once. In the case where the continuous printing count Nc is incremented by one every time the photoconductive drum 31 rotates once, one count corresponds to an image formation length of 94.2 mm for one rotation where the diameter of the photoconductive drum 31 is 30 mm. When vertical feed amount of A6 size is 148 mm and the gap between the labels is 3 mm, the continuous printing count Nc may be incremented by 1.6 every time one label is printed. Therefore, when the 1000 pieces of A6 labels are printed, the continuous printing count Nc may become 1600 counts.

As described above, the continuous printing count Nc may be the number of rotations of the photoconductive drum 31 or the physical quantity correlated with the number of rotations of the photoconductive drum 31. The drum counter 205 may thus count the continuous printing counts Nc as the number of rotations of the photoconductive drum 31 or the physical quantity correlated with the number of rotations of the photoconductive drum 31. The drum counter 205 may measure the number of rotations of the photoconductive drum 31 or the physical quantity correlated with the number of rotations of the photoconductive drum 31 by a method other than the method described above. Note that "number of rotations of photoconductive drum 31 or physical quantity correlated with number of rotations of photoconductive drum 31" is referred to as "result counted by drum counter 205" in the following description.

The operation panel 206 may display a state of the image forming apparatus 1 or display information to prompt a user to action. The operation panel 206 may display a plurality of kinds of printing paper and a plurality of kinds of printing modes to make the user select printing paper and a printing mode. The operation panel 206 may transfer the printing mode selected by the user to the CPU 201. Examples of the printing modes may include free layout printing and label printing. The free layout printing may be printing according to a layout specified by the print data Dp. The label printing may be printing on rolled paper attached with a plurality of labels LB at a predetermined interval.

In the case where the printing mode selected by the user is the label printing, the operation panel 206 may allow the user to input the label size LS and the label gap size GS. At this time, the operation panel 206 may transfer the label size LS and the label gap size GS inputted (externally) by the user, to the CPU 201. In the case where the printing mode selected by the user is the label printing, the controller 200 may extract the label size LS and the label gap size GS from the print data Dp. In this case, it is necessary for the print data Dp to include the label size LS and the label interval size GS, in addition to the image data Di.

The host I/F 207 may acquire the print data Dp that is transmitted from the external information processor 400 coupled to the image forming apparatus 1, and may transfer the print data Dp to the CPU 201. The external I/F 208 may transfer the control signal transmitted from the CPU 201, to the process control section 300, and may transfer data (such as density data) transmitted from the process control section 300, to the CPU 201.

The voltage setting section 209 may set the development voltage $V_{34}$ to be applied to the developing roller 34, based on the density of the non-printing-use toner image Ib detected by the density sensor 70. The voltage setting section 209 may set the development voltage $V_{34}$ to be applied to the developing roller 34, based on the detected signal outputted from the density sensor 70. The voltage setting section 209 may set the development voltage $V_{34}$ to be applied to the developing roller 34 for each of the image forming units 30Y, 30M, 30C, and 30K. The voltage setting section 209 may store, as the setting value $V_{34S}$, the development voltage $V_{34}$ set for each of the image forming units 30Y, 30M, 30C, and 30K in the non-volatile memory 204. Note that the voltage setting section 209 may set the development voltage $V_{34}$ to be applied to the developing roller 34 by a method common to the image forming units 30Y, 30M, 30C, and 30K. Thus, a method of setting the development voltage $V_{34}$ to be applied to the developing roller 34 of the image forming unit 30Y is described below as a representative of the image forming units 30Y, 30M, 30C, and 30K.

The voltage setting section 209 may set the development voltage $V_{34}$ to be applied to the developing roller 34 of the image forming unit 30Y in the following manner, for example. The voltage setting section 209 may first derive the voltage setting expression 220 while varying the development voltage $V_{34}$ to be applied to the developing roller 34 of the image forming unit 41, based on the detection signals obtained from respective three non-printing-use toner images Ib formed on the transfer belt 41.

For example, it is assumed that the detection signal obtained when the development voltage $V_{34}$ is set to −140 V is a signal corresponding to the OD value of 1.45. Also, for example, it is assumed that the detection signal obtained when the development voltage $V_{34}$ is set to −200 V is a signal corresponding to the OD value of 1.55. Also, for example, it is assumed that the detection signal obtained when the development voltage $V_{34}$ is set to −260 V is a signal corresponding to the OD value of 1.65. The voltage setting section 209 may derive an approximate straight line from the three setting values $V_{34S}$ of the development voltage $V_{34}$ and the three measured OD values. The approximate straight line may be represented by, for example, the voltage setting expression 220 in FIG. 5. Subsequently, the voltage setting section 209 may derive the development voltage $V_{34}$ corresponding to the target value Dg of the OD value set by the user, with use of the derived approximate straight line. For example, when the target value Dg of the image density $D_I$ is adjusted to the OD value of 1.5, the voltage setting section 209 may set, for example, −170 V to the setting value $V_{34S}$ of the development voltage $V_{34}$ corresponding to the target value Dg, with use of the voltage setting expression 220 in FIG. 5.

The voltage setting section 209 may further set the supply voltage $V_{35}$, based on the value of the development voltage $V_{34}$. Specifically, the voltage setting section 209 may set the supply voltage $V_{35}$ to allow a potential difference between the development voltage $V_{34}$ and the supply voltage $V_{35}$ to be a fixed value. When the voltage setting section 209 sets, for example, −170 V to the setting value $V_{34S}$, the voltage setting section 209 may set −270 V to the setting value $V_{35S}$ of the supply voltage $V_{35}$.

The voltage correction section 210 may correct the development voltage $V_{34}$ with use of, for example, the correction table 230. The voltage correction section 210 may read, for example, a correction value assigned to the range R1 including the result counted by the drum counter 205, from the correction table 230 in the non-volatile memory 204, and may correct the development voltage $V_{34}$ with use of the read correction value. The voltage correction section 210 may further read, for example, the correction value assigned to the range R2 including the result counted by the drum counter 205, from the correction table 230 in the non-volatile memory 204, and may correct the development voltage $V_{34}$ with use of the read correction value. The voltage correction section 210 may correct the supply voltage $V_{35}$ to allow the potential difference between the development voltage $V_{34}$ and the supply voltage $V_{35}$ to be a fixed value, with use of the corrected development voltage $V_{34}$.

Next, the process control section 300 is described. The process control section 300 may include, for example, a fixation control section 301, the motor control section 302, the high-voltage control section 303, and an exposure control section 304. The fixation control section 301 may control the heat source in the upper roller 51 to allow the temperature of the upper roller 51 to be the set fixation temperature, under the control of the controller 200. The motor control section 302 may control motors rotating the photoconductive drum 31 and other various rollers, under the control of the controller 200.

The exposure control section 304 may control the exposure operation of the LED head 33 under the control of the controller 200. The exposure control section 304 may convert the print data Dp received from the controller 200 into exposure data, and may provide the exposure data to the LED heads 33 of the respective image forming units 30Y, 30M, 30C, and 30K.

When the photoconductive drum 31, the developing roller 34, and the feeding roller 35 rotate after the printing start in the label printing mode, the exposure control section 304 may control the exposure operation of the LED head 33 to allow a plurality of electrostatic latent images Ia to be formed side by side at a predetermined interval on the circumferential surface 31A. In the label printing mode, the exposure control section 304 may control the exposure operation, based on the image data Di, the label size LS, and the label gap size GS that are provided from outside. Specifically, the exposure control section 304 may derive the exposure start timing and the exposure end timing of each electrostatic latent image Ia to be formed, to allow each toner image Ib to be transferred on the surface of the label LB, based on the image data Di, the label size LS, and the label gap size GS that are provided from the outside. The exposure control section 304 may provide an exposure control signal 304A to the LED heads 33 of the respective image forming units 30Y, 30M, 30C, and 30K. The exposure control signal 304A may include the derived exposure start timing, the derived exposure end timing, and exposure data. The exposure control signal 304A may be a signal used to control the LED head 33. The exposure control signal 304A corresponds to a specific but non-limiting example of "exposure control signal" in the disclosure. The exposure control section 304 may generate the exposure control signal 304A, based on the image data Di, the label size LS, and the label gap size GS that are provided from the outside.

The high-voltage control section 303 may output a charged voltage $V_{32}$, the development voltage $V_{34}$, the supply voltage $V_{35}$, the primary transfer voltage, and the secondary transfer voltage under the control of the controller 200. The high-voltage control section 303 may apply the charged voltage $V_{32}$ to the charging roller 32. The high-voltage control section 303 may further apply the development voltage $V_{34}$ to the developing roller 34, and may apply the supply voltage $V_{35}$ to the feeding roller 35.

The high-voltage control section 303 may apply the development voltage $V_{34}$ set by the voltage setting section 209, to the developing roller 34 at a predetermined timing. When the development voltage $V_{34}$ is corrected by the voltage correction section 210, the high-voltage control section 303 may apply the corrected development voltage $V_{34}$ to the developing roller 34 during the continuous printing. The high-voltage control section 303 may vary, at a predetermined timing during the continuous printing, the development voltage $V_{34}$ to be applied to the developing roller 34 from the development voltage $V_{34}$ before the correction to the corrected development voltage $V_{34}$. Specifically, the controller 200 may vary the development voltage $V_{34}$ from the development voltage $V_{34}$ before the correction to the corrected development voltage $V_{34}$ at a predetermined timing during the continuous printing without stopping the printing. The high-voltage control section 303 may apply the latest development voltage $V_{34}$ (i.e., the development voltage $V_{34}$ before the next correction) to the developing roller 34 until the next correction is performed by the voltage correction section 210.

The high-voltage control section 303 may apply the supply voltage $V_{35}$ set by the voltage setting section 209, to the feeding roller 35 at a predetermined timing. When the supply voltage $V_{35}$ is corrected by the voltage correction section 210, the high-voltage control section 303 may apply the corrected supply voltage $V_{35}$ to the feeding roller 35 during the continuous printing. The high-voltage control section 303 may vary, at a predetermined timing during the continuous printing, the supply voltage $V_{35}$ to be applied to the feeding roller 35 from the supply voltage $V_{35}$ before the correction to the corrected supply voltage $V_{35}$. Specifically, the controller 200 may vary the supply voltage $V_{35}$ from the supply voltage $V_{35}$ before the correction to the corrected supply voltage $V_{35}$ at a predetermined timing during the continuous printing without stopping the printing. The high-voltage control section 303 may apply the latest supply voltage $V_{35}$ (i.e., the supply voltage $V_{35}$ before next correction) to the feeding roller 35 until the next correction is performed by the voltage correction section 210.

Figure 8A:
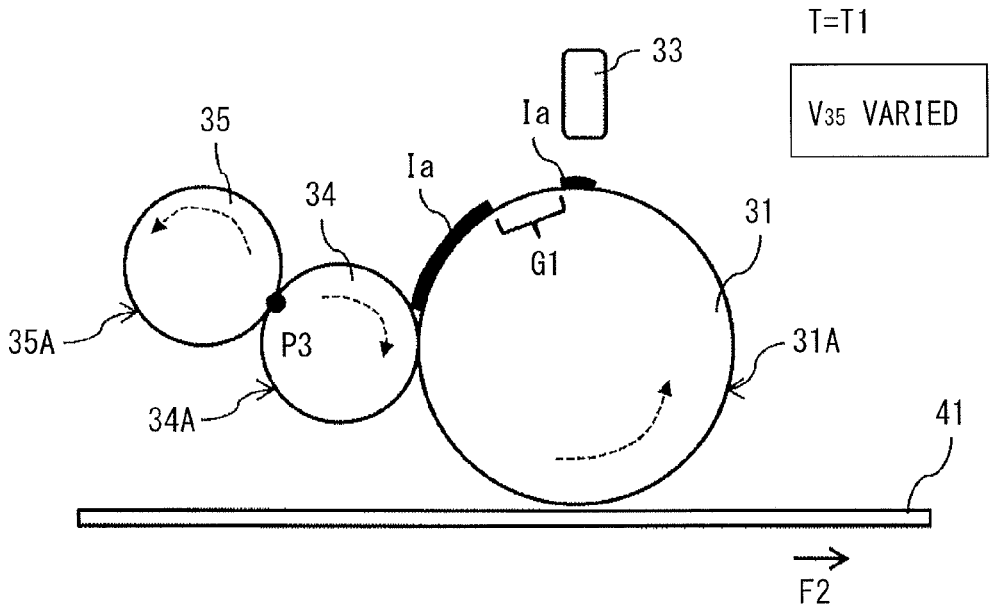
FIG. 8A is a diagram illustrating an example of operation of the image forming unit at time T=T1.
Figure 8B:
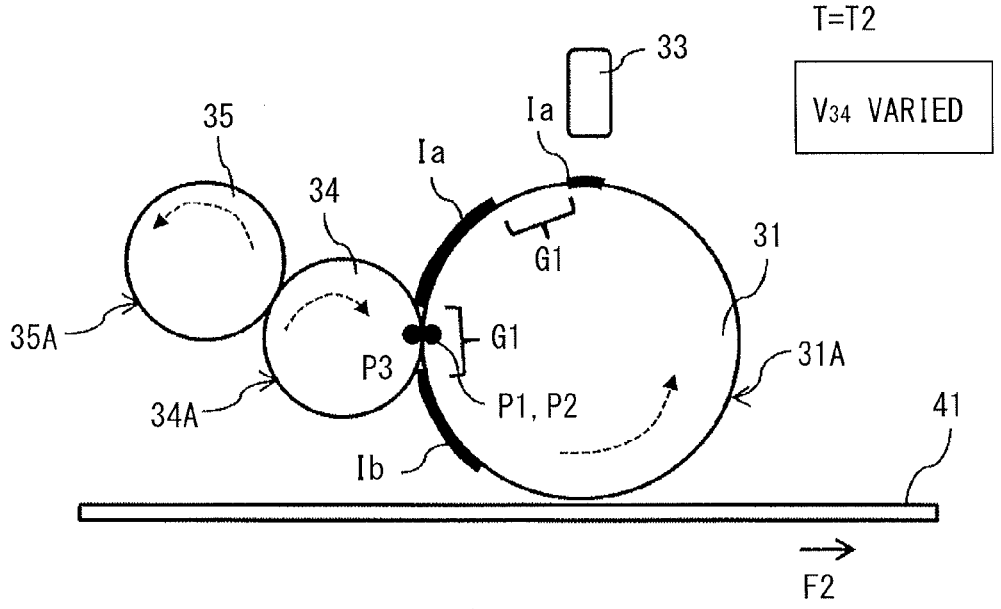
FIG. 8B is a diagram illustrating an example of the operation of the image forming unit at time T=T2.
Figure 8C:
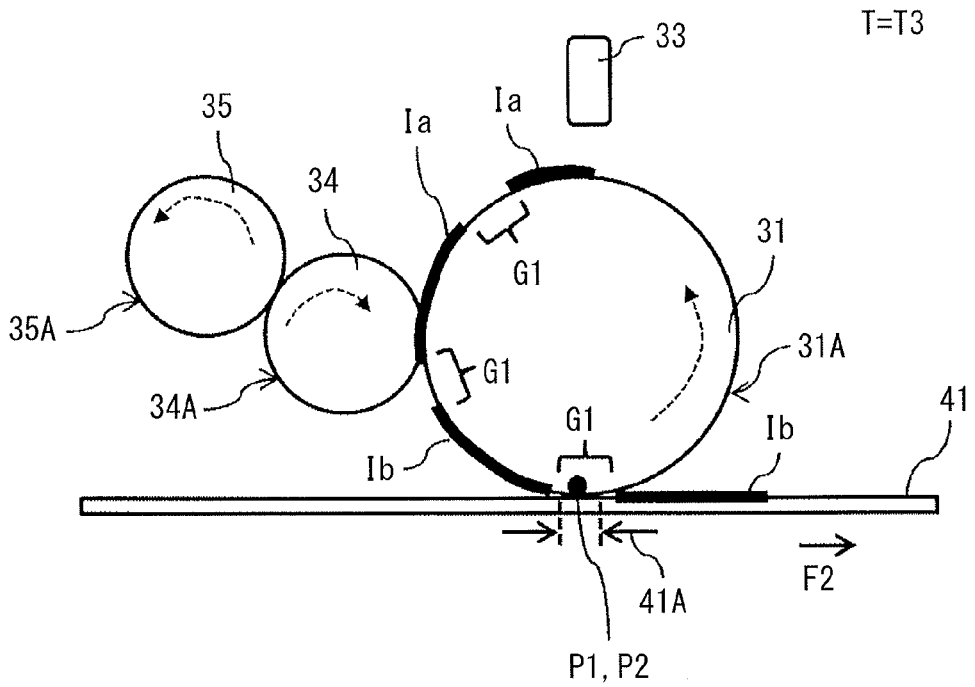
FIG. 8C is a diagram illustrating an example of the operation of the image forming unit at time T=T3.
Figure 9:
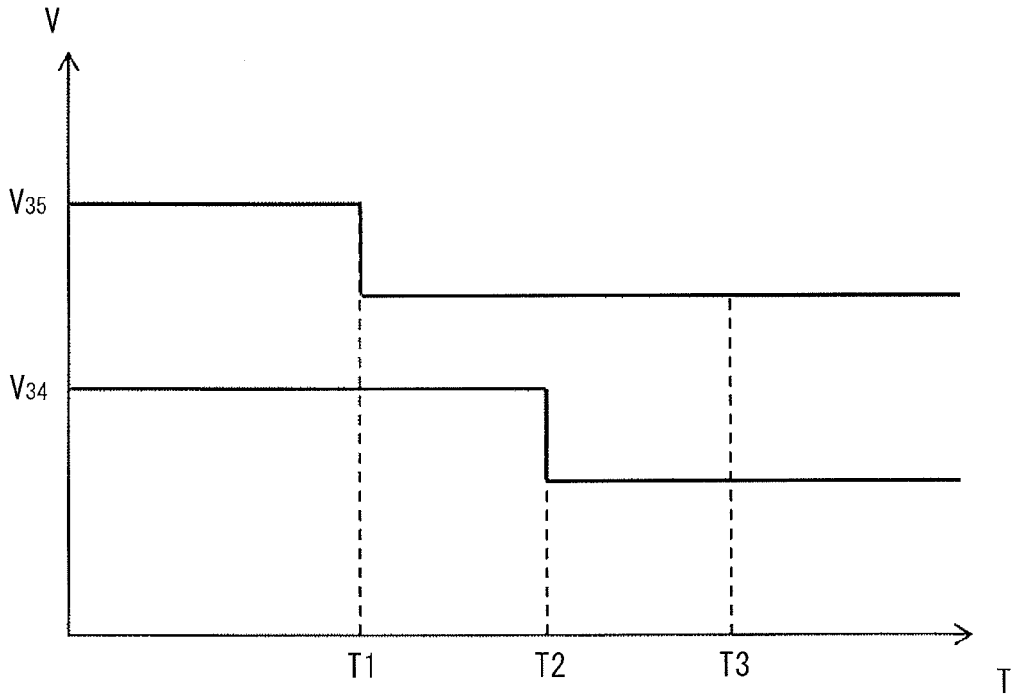
FIG. 9 is a diagram illustrating an example of varying of a development voltage and a supply voltage.

FIG. 8A illustrates an example of the operation of the image forming unit 30Y when the supply voltage $V_{35}$ is varied (time T=T1) immediately before the development voltage $V_{34}$ is varied. FIG. 8B illustrates an example of the operation of the image forming unit 30Y when the development voltage $V_{34}$ is varied (time T=T2) immediately after the supply voltage $V_{35}$ is varied. FIG. 8C illustrates an example of the operation of the image forming unit 30Y immediately after the development voltage $V_{34}$ is varied (time T=T3). FIG. 9 illustrates an example of the voltage varying of the development voltage $V_{34}$ and the supply voltage $V_{35}$.

Note that time difference T2−T1 may correspond to a time necessary for a portion P3 described later to travel from a position at which the portion P3 is opposed to the circumferential surface 35A of the feeding roller 35 to a position at which the portion P3 is opposed to the circumferential surface 31A of the photoconductive drum 31, in the circumferential surface 34A of the developing roller 34 while the photoconductive drum 31, the developing roller 34, and the feeding roller 35 rotate. Also, time difference T3−T2 may correspond to a time necessary for a portion P1 described later to travel from a position at which the portion P1 is opposed to the circumferential surface 34A of the developing roller 34 to a position at which the portion P1 is opposed to the surface of the transfer belt 41, in the circumferential surface 31A of the photoconductive drum 31, while the photoconductive drum 31, the developing roller 34, and the feeding roller 35 rotate.

The high-voltage control section 303 may control the varying timing of the development voltage $V_{34}$ resulting from the correction of the development voltage $V_{34}$. In the label printing mode, the high-voltage control section 303 may control the varying timing of the development voltage $V_{34}$, based on the label size LS and the label gap size GS that are provided from the outside. The high-voltage control section 303 may perform this control while the exposure control section 304 controls, based on the image data Di, the label size LS, and the label gap size GS that are provided from the outside, the exposure operation.

Specifically, in the label printing mode, the high-voltage control section 303 may control the varying timing of the development voltage $V_{34}$ to allow a portion P1 to be located within a gap G1 between the electrostatic latent images of the circumferential surface 31A as illustrated in FIG. 8B and FIG. 9. The high-voltage control section 303 may perform the control while the exposure control section 304 controls the exposure operation of the LED head 33 to allow the plurality of electrostatic latent images Ia to be formed side by side at a predetermined interval on the circumferential surface 31A of the photoconductive drum 31. The portion P1 may be a portion, in the circumferential surface 31A, opposed to the developing roller 34 upon varying of the development voltage $V_{34}$. The gap G1 between the electrostatic latent images may be a gap between the electrostatic latent images Ia adjacent to each other. The gap G1 between the electrostatic latent images corresponds to a specific but non-limiting example of "gap between latent images".

In the label printing mode, the high-voltage control section 303 may control the varying timing of the development voltage $V_{34}$ to allow the portion P1 to be opposed to the portion 41A that is opposed to the gap LG between labels in the transfer belt 41 as illustrated in FIG. 8C and FIG. 9. The high-voltage control section 303 may perform the control while the exposure control section 34 controls the exposure operation of the LED head 33 to allow the plurality of electrostatic latent images Ia to be formed side by side at a predetermined interval on the circumferential surface 31A.

The high-voltage control section 303 may control the varying timing of the supply voltage $V_{35}$ resulting from correction of the supply voltage $V_{35}$ that is associated with the correction of the development voltage $V_{34}$. In the label printing mode, the high-voltage control section 303 may correct the development voltage $V_{34}$ after correcting the supply voltage $V_{35}$.

In the label printing mode, the high-voltage control section 303 may control the varying timing of the supply voltage $V_{35}$, based on the label size LS and the label gap size GS that are provided from the outside. The high-voltage control section 303 may perform the control while the exposure control section 304 controls, based on the image data Di, the label size LS, and the label gap size GS that are provided from the outside, the exposure operation.

Specifically, in the label printing mode, the high-voltage control section 303 may preferably control the varying timing of the supply voltage $V_{35}$ to allow a portion P2 to be located within the gap G1 between the electrostatic latent images of the circumferential surface 31A as illustrated in FIG. 8A, FIG. 8B, and FIG. 9. The high-voltage control section 303 may perform the control while the exposure control section 304 controls the exposure operation of the LED head 33 to allow the plurality of electrostatic latent images Ia to be formed side by side at a predetermined interval on the circumferential surface 31A of the photoconductive drum 31. The portion P2 may be a portion, in the circumferential surface 31A, opposed to a portion P3 of the developing roller 34. The portion P3 may be a portion, in the circumferential surface 34A of the developing roller 34, opposed to the feeding roller 35 upon varying of the voltage $V_{34}$.

In the label printing mode, the high-voltage control section 303 may control the varying timing of the supply voltage $V_{35}$ to allow the portion P2 to be opposed to the portion 41A that is opposed to the gap LG between labels, in the transfer belt 41 as illustrated in FIG. 8C and FIG. 9. The high-voltage control section 303 may perform the control while the exposure control section 304 controls the exposure operation of the LED head 33 to allow the plurality of electrostatic latent images Ia to be formed side by side at a predetermined interval on the circumferential surface 31A.

Figure 10:
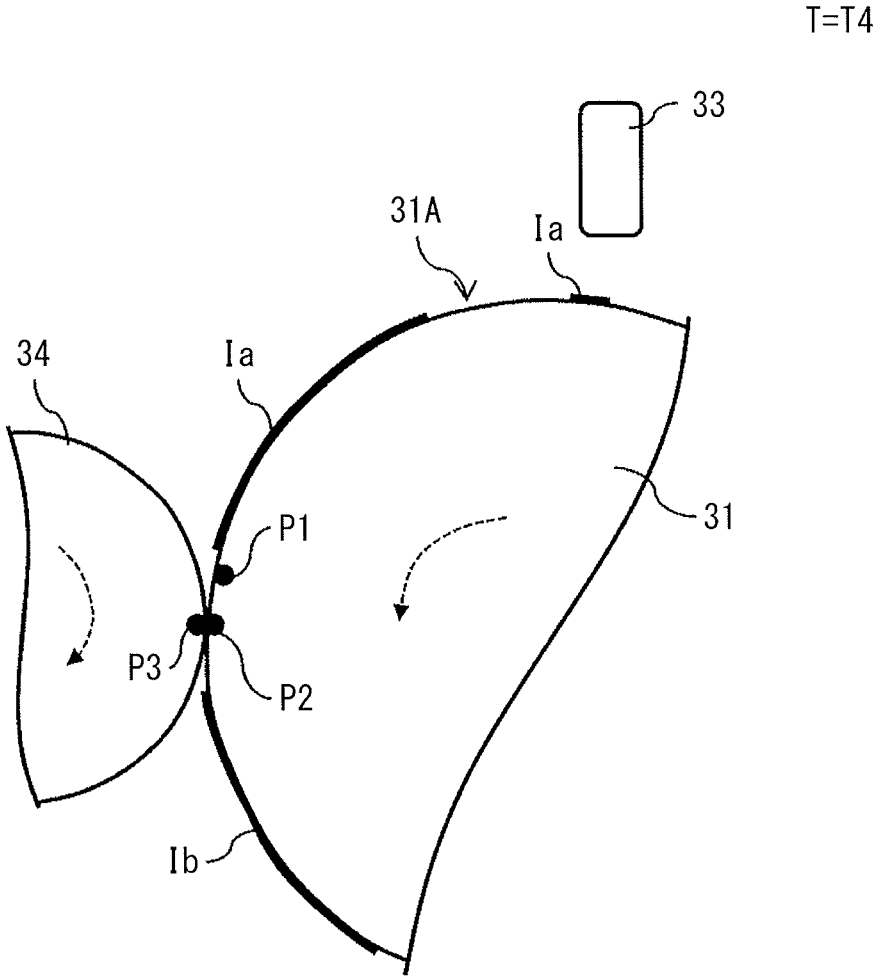
FIG. 10 is a diagram illustrating an example of the operation of the image forming unit at time T=T4.
Figure 11:
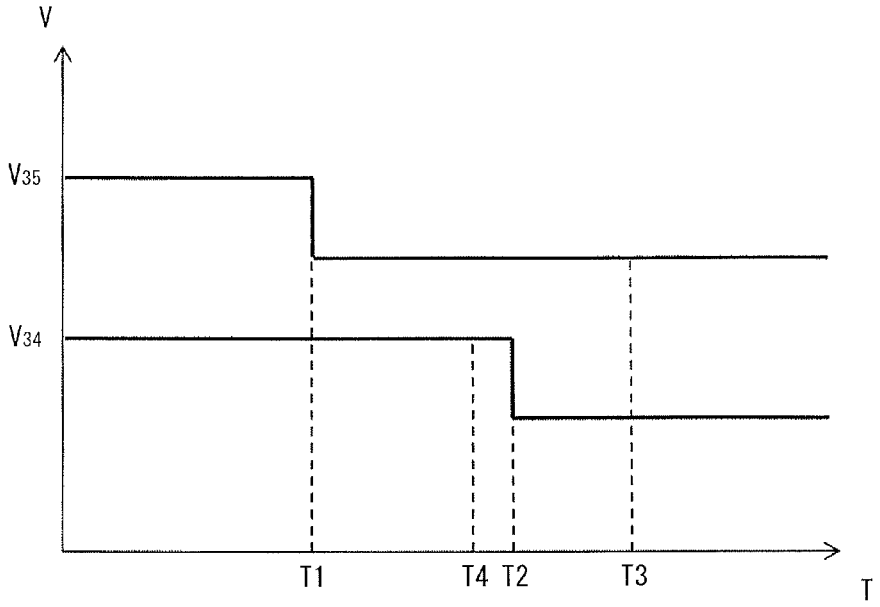
FIG. 11 is a diagram illustrating an example of varying of a development voltage and a supply voltage.

In FIG. 8B and FIG. 8C, the high-voltage control section 303 may control the varying timing of both of the development voltage $V_{34}$ and the supply voltage $V_{35}$ to allow both of the portions P1 and P2 to be coincident with each other. Note that the high-voltage control section 303 may control the varying timing of both of the development voltage $V_{34}$ and the supply voltage $V_{35}$ to allow the portion P2 to be located upstream of the portion P1 in the rotation direction of the circumferential surface 31A of the photoconductive drum 31 as illustrated in FIG. 10 and FIG. 11. Note that FIG. 10 illustrates an example of the operation of the image forming unit 30Y when the portion P2 is opposed to the portion P3 (time T=T4) immediately after the supply voltage $V_{35}$ is varied. FIG. 11 illustrates an example of the voltage varying of the development voltage $V_{34}$ and the supply voltage $V_{35}$.

In FIGS. 8A to 11, variation in thickness and charged amount of the toner 37 attached on the circumferential surface 34A of the developing roller 34 resulting from the varying of the supply voltage $V_{35}$ may reach a portion, in the circumferential surface 34A of the developing roller 34, opposed to the circumferential surface 31A of the photoconductive drum 31 upon or before varying of the development voltage $V_{34}$. As a result, it is possible to suppress large variation in the image density $D_I$ before and after varying of the development voltage $V_{34}$, as compared with the case where variation in the thickness and the charged amount of the toner 37 attached on the circumferential surface 34A of the developing roller 34 resulting from varying of the supply voltage $V_{35}$ reaches a portion, in the circumferential surface 34A of the developing roller 34, opposed to the circumferential surface 31A of the photoconductive drum 31 after varying of the development voltage $V_{34}$. Note that the variation in the image density $D_I$ resulting from the varying of the supply voltage $V_{35}$ may be smaller than the variation in the image density $D_I$ resulting from the varying of the development voltage $V_{34}$. Therefore, in the label printing mode, there may be a case where the portion P2 is accepted to be located at a position outside the gap G1 between the electrostatic latent images of the circumferential surface 31A.

The controller 200 may stop printing every time the result counted by the drum counter 205 exceeds the threshold Nt_th. The controller 200 may further control the image forming section 30 and the transfer section 40 to allow the plurality of non-printing-use toner images Ib with different development voltages from one another to be formed on the transfer belt 41 while the printing is stopped. At this time, the voltage correction section 210 may reset the result counted by the drum counter 205 stored in the non-volatile memory 204 every time the printing is stopped. The density sensor 70 may detect the density of the non-printing-use toner image Ib on the transfer belt 41 while the printing is stopped. The voltage setting section 209 may set the development voltage $V_{34}$ to be applied to the developing roller 34, based on the density of the toner image Ib detected by the density sensor 70, every time the detection by the density sensor 70 is performed. The controller 200 may start printing after the development voltage $V_{34}$ is set by the voltage setting section 209. The high-voltage control section 303 may apply the reset development voltage $V_{34}$ to the developing roller 34 every time the development voltage $V_{34}$ is reset by the voltage setting section 209.

[Operation]

The operation of the image forming apparatus 1 is described. In the image forming apparatus 1, the toner image Ib may be formed with respect to the medium P in the following way. When the printing job is supplied to the CPU 201 from the image processor 400 coupled to the image forming apparatus 1, the CPU 201 may perform the printing processing to allow each component in the image forming apparatus 1 to perform the following operation, based on the printing job.

First, heating of the upper roller 51 by the heater may be started. When the temperature of the upper roller 51 reaches the predetermined temperature, the medium P contained in the medium container 10 may be taken out by the delivering roller pair 21, and the medium P may be then delivered to the conveying path PW. The medium P delivered to the conveying path PW may be then conveyed through the conveying path PW by the conveying roller pair 22 in the conveying direction F1, and then skewing of the medium P may be corrected by the resist roller pair 23. The operation of both of the image forming section 30 and the transfer section 40 may be started at respective predetermined timings, and the medium P may be conveyed to the transfer section 40, and the toner image formed by the image forming section 30 in the following manner may be transferred on the medium P. The image may be printed on the medium P in the foregoing way.

In the image forming section 30, the toner image Ib may be formed by the following electrophotographic process. When the charged voltage $V_{32}$ is applied from the high-voltage control section 303 to the charging roller 32, the surface (the surface layer) of the charging roller 32 may be uniformly charged, and the portion of the circumferential surface 31A of the photoconductive drum 31 opposed to the charging roller 32 may be accordingly charged to the predetermined voltage (for example, −600 V). Then, when the illumination light is applied from the LED head 33 toward the charged region of the circumferential surface 31A of the photoconductive drum 31 and the circumferential surface 31A of the photoconductive drum 31 is thereby exposed, the electrostatic latent image Ia corresponding to the printing pattern that is specified by the above-described printing job may be formed on the circumferential surface 31A. At this time, the voltage of the portion of the circumferential surface 31A of the photoconductive drum 31 corresponding to the electrostatic latent image Ia may be, for example, about 0 V.

When the supply voltage $V_{35}$ is applied from the high-voltage control section 303 to the feeding roller 35, the surface (the surface layer) of the feeding roller 35 may be charged to the predetermined voltage (for example, −300 V). Likewise, when the development voltage $V_{34}$ is applied from the high-voltage control section 303 to the developing roller 34, the surface (the surface layer) of the developing roller 34 may be charged to the predetermined voltage (for example, −205 V). At this time, the feeding roller 35 may be opposed to the developing roller 34, and the feeding roller 35 and the developing roller 34 may rotate at respective predetermined circumferential velocities. This allows the toner 37 charged to negative to be attracted by the developing roller 34 due to potential difference between the voltage $V_{35}$ of the feeding roller 35 and the voltage $V_{34}$ of the developing roller 34. As a result, the toner 37 may be supplied from the surface of the feeding roller 35 to the surface of the developing roller 34. Subsequently, the toner 37 on the developing roller 34 may be charged by, for example, friction by the regulation blade 38 in contact with the developing roller 34. Here, the thickness of the toner 37 on the developing roller 34 may be defined by, for example, the development voltage $V_{34}$ of the developing roller 34, the supply voltage $V_{35}$ of the feeding roller 35, and the pressing pressure of the regulation blade 38. The developing roller 34 may be opposed to the photoconductive drum 31, and the developing roller 34 and the photoconductive drum 31 may rotate at respective predetermined circumferential velocities. Therefore, the negatively-charged toner 37 may be attracted to the photoconductive drum 31 by the potential difference between the development voltage $V_{34}$ of the developing roller 34 and the voltage at the portion, in the circumferential surface 31A of the photoconductive drum 31, corresponding to the electrostatic latent image Ia. As a result, the toner 37 may be attached to the electrostatic latent image Ia on the photoconductive drum 31, and the toner image Ib may be accordingly formed. Note that, since the voltage of the portion, in the circumferential surface 31A of the photoconductive drum 31, corresponding to the charged region is lower than the development voltage $V_{34}$ of the developing roller 34, the negatively-charged toner 37 may not be attracted to the charged region.

Thereafter, the toner image Ib on the photoconductive drum 31 may be transferred to the transfer belt 41 by means of an electric field between the photoconductive drum 31 and the primary transfer roller 44. Note that the toner 37 remained on the surface of the photoconductive drum 31 may be removed by being scraped by the cleaning blade 39. Subsequently, the toner image Ib on the transfer belt 41 may be transferred on the medium P by an electric field between the counter roller 45 and the primary transfer roller 46. The toner 37 remained on the surface of the transfer belt 41 may be removed by being scraped by the cleaning blade 39. The toner image may be then fixed on the medium P by being applied with heat and pressure by the fixing section 50.

An operation of the image forming apparatus 1 is described in detail. The operation of the image forming apparatus 1 at the time of setting or correcting the development voltage $V_{34}$ and the supply voltage $V_{35}$ is specifically described in detail below.

Figure 12:
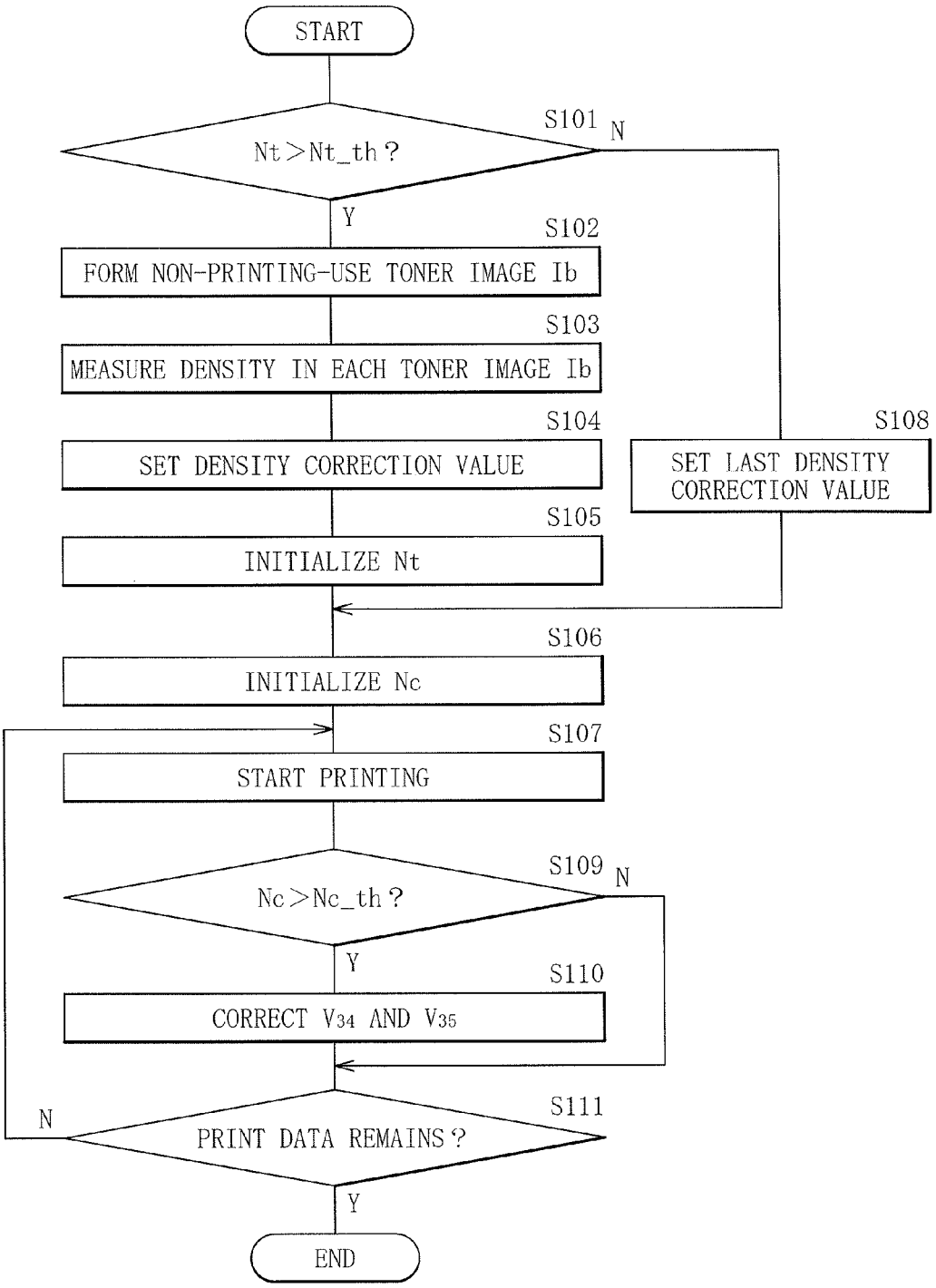
FIG. 12 is a flowchart illustrating an example of operation procedure of the image forming apparatus in FIG. 1.

FIG. 12 illustrates an example of operation procedure of the image forming apparatus 1. The printing job may be supplied, to the CPU 201 through communication network, from an image transfer apparatus coupled to the image forming apparatus 1. The CPU 201 may then perform the printing processing to allow each component in the image forming apparatus 1 to perform the following operation, based on the printing job.

The CPU 201 may determine whether the result counted by the drum counter 205 (the continuous printing count Nc) exceeds the threshold Nt_th (step S101). When the continuous printing count Nc exceeds the threshold Nt_th, the CPU 201 may perform density correction.

Specifically, the CPU 201 may first instruct each of the image forming units 30Y, 30M, 30C, and 30K of the image forming section 30 to form three non-printing-use toner images Ib with development voltages $V_{34}$ different from one another. Then, the three non-printing-use toner images with the development voltages $V_{34}$ different from one another may be formed on the circumferential surface 31A of the photoconductive drum 31 of each of the image forming units 30Y, 30M, 30C, and 30K. The CPU 201 may also instruct the image forming section 30 and the transfer section 40 to transfer the non-printing-use toner images Ib formed by the image forming section, on the transfer belt 41. This causes the non-printing use toner images Ib formed on the circumferential surface 31A to be transferred on the transfer belt 41. The non-printing-use toner images Ib may be formed on the transfer belt 41 in this way (step S102).

The CPU 201 may then instruct the density sensor 70 to perform density measurement. Thus, light may be applied from the density sensor 70 to each of the non-printing-use toner images Ib on the transfer belt 41, and light reflected by each of the non-printing-use toner images Ib may be detected by the density sensor 70. As a result, a detection signal relating to the intensity $I_R$ of light reflected by each of the non-printing-use toner images Ib may be outputted from the density sensor 70. The density of each of the non-printing-use toner images Ib may be detected in this way (step S103).

The CPU 201 may then instruct the voltage setting section 209 to derive the voltage setting expression 220. The voltage setting section 209 may then derive the voltage setting expression 220 for each of the image forming units 30Y, 30M, 30C, and 30K, based on the detection signals outputted from the density sensor 70 and the development voltage $V_{34}$ applied to each of the image forming units 30Y, 30M, 30C, and 30K. The voltage setting section 209 may further derive the setting value $V_{34S}$ of the development voltage $V_{34}$ corresponding to the target value Dg and the setting value $V_{35S}$ of the supply voltage $V_{35}$ corresponding to the setting value $V_{34S}$ for each of the image forming units 30Y, 30M, 30C, and 30K, with use of the derived voltage setting expression 220. The voltage setting section 209 may store the derived setting value $V_{34S}$ and the derived setting value $V_{35S}$ in the non-volatile memory 106. The density correction value may be set in this way (step S104).

The CPU 201 may then initialize the continuous printing count Nc, and may then start printing with use of the derived setting value $V_{34S}$ and the derived setting value $V_{35S}$ (steps S106 and S107). Also in the case where the accumulated count Nt is smaller than the threshold Nt_th, the CPU 201 may initialize the continuous printing count Nc, and may then start printing with use of the derived setting value $V_{34S}$ (steps S106 and S107). In the case where the continuous printing count Nt is smaller than the threshold Nt_th, however, the last density correction value may be set (step S108). In printing, the CPU 201 may instruct the high-voltage control section 303 to output the development voltage $V_{34}$ of the derived setting value $V_{34S}$ and the supply voltage $V_{35}$ of the derived setting value $V_{35S}$. The development voltage $V_{34}$ of the derived setting value $V_{34S}$ may be thus applied to the development roller 34, and the supply voltage $V_{35}$ of the derived setting value $V_{35}$ may be thus provided to the feeding roller 35.

The CPU 201 may then instruct the voltage correction section 210 to correct the development voltage $V_{34}$. The voltage correction section 210 may then correct the development voltage $V_{34}$, based on the continuous printing count Nc counted by the drum counter 205. Specifically, the voltage correction section 210 may determine whether the continuous printing count Nc counted by the drum counter 205 exceeds the threshold Nc_th (step S109). When the continuous printing count Nc exceeds the threshold Nc_th, the voltage correction section 210 may correct the development voltage $V_{34}$. Specifically, the voltage correction section 210 may read out, from the correction table 230, a correction value that is assigned to a range Ac1 including the continuous printing count Nc and is assigned to a range Ac2 including the setting value $V_{34S}$ of the development voltage $V_{34}$. The voltage correction section 210 may then correct the development voltage $V_{34}$ with use of the read correction value (step S110). For example, the voltage correction section 210 may add the correction value read out from the correction table 230 to the development voltage $V_{34}$. The voltage correction section 210 may further correct the supply voltage $V_{35}$. Specifically, the voltage correction section 210 may correct the supply voltage $V_{35}$ to allow the potential difference between the development voltage $V_{34}$ and the supply voltage $V_{35}$ to be fixed. When the continuous printing count Nc is smaller than the threshold value Nc_th, the voltage correction section 210 may not correct the development voltage $V_{34}$ and the supply voltage $V_{35}$.

The CPU 201 may then instruct the high-voltage control section 203 to output the corrected development voltage $V_{34}$ and the corrected supply voltage $V_{35}$. Specifically, the CPU 201 may instruct the high-voltage control section 203 to change the voltage to be outputted to the developing roller 34 from the development voltage $V_{34}$ before the correction to the corrected development voltage $V_{34}$. Thus, the voltage to be outputted to the developing roller 34 may be changed from the development voltage $V_{34}$ before the correction to the corrected development voltage $V_{34}$. The CPU 201 may further instruct the high-voltage control section 203 to change the voltage to be outputted to the feeding roller 35 from the supply voltage $V_{35}$ before the correction to the corrected supply voltage $V_{35}$. Thus, the voltage to be outputted to the feeding roller 35 may be changed from the supply voltage $V_{35}$ before the correction to the corrected supply voltage V. In each of the image forming units 30Y, 30M, 30C, and 30K, the corrected development voltage $V_{34}$ and the corrected supply voltage $V_{35}$ may be applied, for example, at respective timings illustrated in FIG. 8A to FIG. 11.

The CPU 201 may then determine whether the print data Dp remains (step S111). When no print data Dp remains, the CPU 201 may complete the printing. When the print data Dp remains, the CPU 201 may continue printing to execute the step S107.

[Effects]

Some effects of the image forming apparatus 1 of the present embodiment are described. In general, in an electrophotographic image forming apparatus, toner amount to be transferred on paper is strictly controlled in order to faithfully reproduce a color image. For example, toner density of a patch pattern printed on the transfer belt may be measured, and a process condition may be controlled based on the density data obtained through the measurement. To measure the toner density of the patch pattern, it is necessary to interrupt normal printing. This makes it difficult to measure the toner density of the patch pattern in printing. Accordingly, in the case where the continuous printing time is long under the process condition set once, printed image density may be varied between at the beginning of the printing and after the longtime printing.

In contrast, in the image forming apparatus 1 according to the present embodiment, the development voltage $V_{34}$ set before the printing start may be corrected based on the result counted by the drum counter 205. Further, the supply voltage $V_{35}$ set before the printing start may be corrected based on the corrected development voltage $V_{34}$. This makes it possible to perform correction based on the number of rotations of the photoconductive drum 31 on the development voltage $V_{34}$ and the supply voltage $V_{35}$ that are set before the printing start, without stopping the printing during the continuous printing. As a result, it is possible to stabilize the printed image density in longtime printing.

Incidentally, in general, in the case where printing in which printing operation is difficult to be interrupted is performed over long time, density correction of the developer may have to be performed during the printing operation. In such a case, the density or color tone may be largely varied in a printed image. For example, in the case where the label printing is performed on the rolled paper, the gap LG between labels may be extremely small, for example, about 3 mm and fixed. Therefore, the density correction of the toner 37 may have to be performed during development of the image (the toner image Ib) to be printed on the label LB. In such a case, however, the density or the color tone may be largely varied in the developed toner image Ib.

In contrast, in the image forming apparatus 1 according to the present embodiment, in the label printing mode, the varying timing of the development voltage $V_{34}$ or the varying timing of both of the development voltage $V_{34}$ and the supply voltage $V_{35}$ may be controlled to allow the portion P1 to be located within the gap G1 between the electrostatic latent images on the circumferential surface 31A as illustrated in FIG. 8B and FIG. 9 while exposure operation of the LED head 33 is controlled to allow the plurality of electrostatic latent images Ia to be formed side by side at a predetermined interval on the circumferential surface 31A. In the present embodiment, the varying timing of the development voltage $V_{34}$ that may cause large variation in the density of the toner image Ib is not included in the period in which the electrostatic latent image Ia is developed. This makes it possible to suppress large variation in density or color tone within the developed toner image Ib.

2. Modifications

Some modifications of the image forming apparatus 1 according to the above-described embodiment are described below. Note that, in the following description, like numerals are used to designate components common to those in the above-described embodiment. Description is mainly given of components different from those in the above-described embodiment, and the description of the components common to those in the above-described embodiment will not be described in detail.

[Modification 1]

Figure 13:
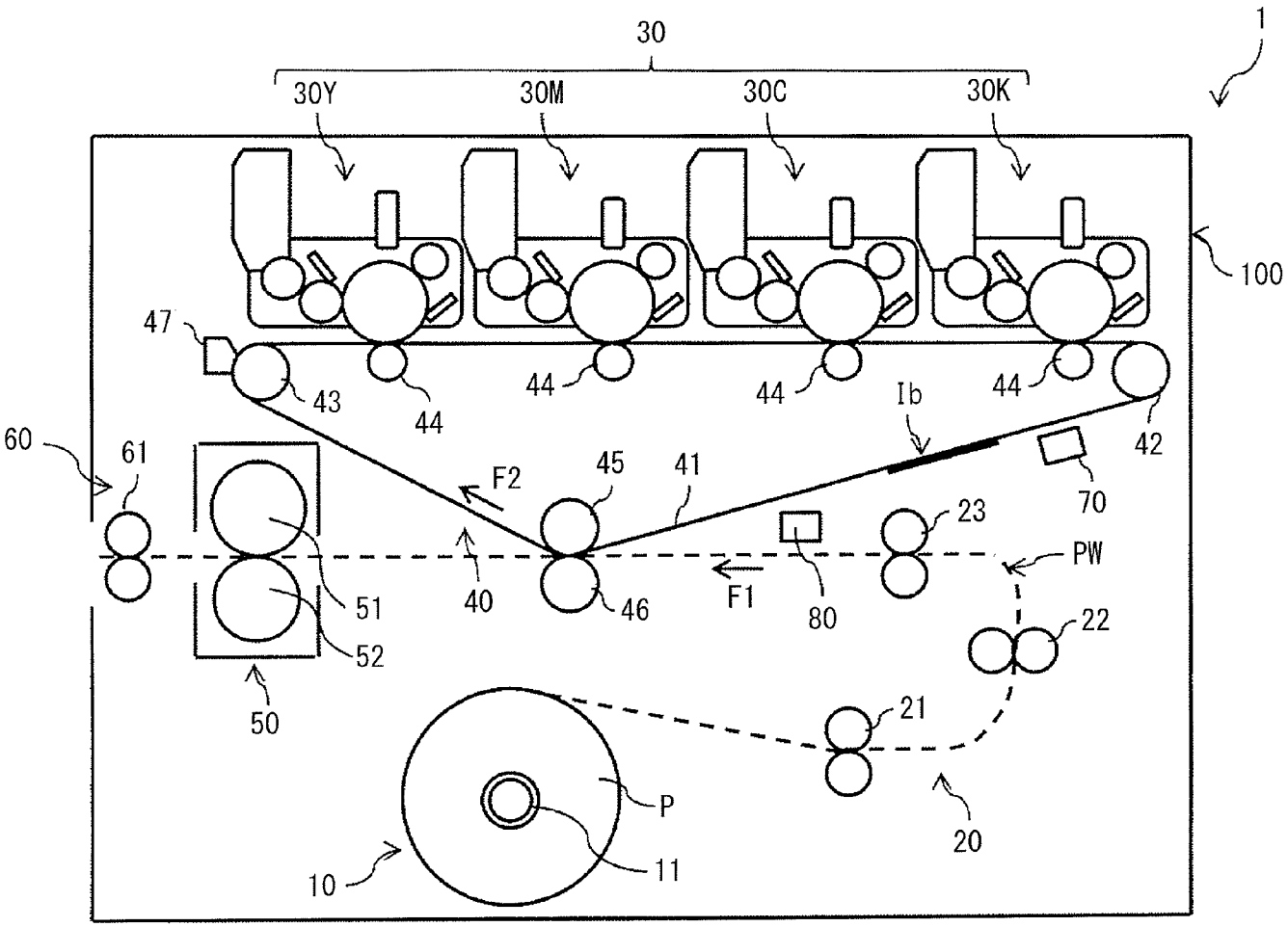
FIG. 13 is a schematic diagram illustrating a modification of the outline configuration of the image forming apparatus in FIG. 1.

In the above-described embodiment, the image forming apparatus 1 may further include a detection section 80, for example, as illustrated in FIG. 13. FIG. 13 schematically illustrates an example of an outline configuration of the image forming apparatus 1 according to the modification 1. The detection section 80 corresponds to a specific but non-limiting example of "detection section" of the disclosure.

In the label printing mode, the detection section 80 may detect the labels LB on the medium P (rolled paper) and may derive the label size LS and the label gap size GS. The detection section 80 may include a light emitting diode (LED) and a photoreceptor diode. The light emitting diode may apply light to the medium P to be conveyed in a segment between the resist roller pair 23 and the transfer section 40 of the conveying path PW, for example. The photoreceptor diode may detect light (reflected light) reflected by the surface of the medium P to be conveyed, out of the light emitted from the light emitting diode. A detection signal outputted from the photoreceptor diode may relate to intensity of the reflected light correlated with irregularity of the surface of the medium P. The detection section 80 may drive the light emitting diode and the photoreceptor diode, for example, based on the control signal provided from the controller 200. The detection section 80 may include a drive circuit that derives the label size LS and the label gap size GS, based on the detection signal provided from the photoreceptor diode and provides the derived label size LS and the derived label gap size GS to the controller 200.

In the modification 1, in the label printing mode, the exposure control section 304 may control the exposure operation, based on the image data Di provided from the outside and the label size LS and the label gap size GS both obtained by the detection section 80. Specifically, in the label printing mode, the exposure control section 304 may derive the exposure start timing and the exposure end timing of each electrostatic latent image Ia to be formed, to allow each toner image Ib to be transferred on the surface of the label LB, based on the image data Di provided from the outside and the label size LS and the label gap size GS both obtained by the detection section 80. The exposure control section 304 may generate the exposure control signal 304A, based on the image data Di provided from the outside and the label size LS and the label gap size GS both obtained by the detection section 80.

The high-voltage control section 303 may control the varying timing of the development voltage $V_{34}$ resulting from the correction of the development voltage $V_{34}$. In the label printing mode, the high-voltage control section 303 may control the varying timing of the development voltage $V_{34}$, based on the label size LS and the label gap size GS obtained by the detection section 80. The high-voltage control section 303 may perform the control while the exposure control section 304 controls the exposure operation, based on the image data Di provided from the outside and the label size LS and the label gap size GS both obtained by the detection section 80.

In the label printing mode, the high-voltage control section 303 may control the varying timing of the supply voltage $V_{35}$, based on the label size LS and the label gap size GS both obtained by the detection section 80. The high-voltage control section 303 may perform the control while the exposure control section 304 controls the exposure operation, based on the image data Di provided from the outside and the label size LS and the label gap size GS both obtained by the detection section 80.

The image forming apparatus 1 according to the modification 1 is different from the image forming apparatus 1 according to the above-described embodiment in that the control based on the label size LS and the label gap size GS obtained by the detection section 80 may be performed. Otherwise, the image forming apparatus 1 according to the modification 1 may include the configuration similar to that of the image forming apparatus 1 according to the above-described embodiment. Therefore, also in the modification 1, effects similar to those in the above-described embodiment are obtainable.

[Modification 2]

In the above-described embodiment and the above-described modification 1, in the label printing mode, the high-voltage control section 303 may control the varying timing of the development voltage $V_{34}$ or both of the development voltage $V_{34}$ and the supply voltage $V_{35}$, based on the exposure control signal 304A generated by the exposure control section 304.

In the modification 2, specifically, the high-voltage control section 303 may extract the exposure start timing and the exposure end timing from the exposure control signal 304A generated by the exposure control section 304. The high-voltage control section 303 may predict the timing at which the gap G1 between the electrostatic latent images is formed, based on the extracted exposure start timing and the extracted exposure end timing, and may control the varying timing of the development voltage $V_{34}$ or both of the development voltage $V_{34}$ and the supply voltage $V_{35}$, based on the predicted timing.

The image forming apparatus 1 according to the modification 2 is different from the image forming apparatus 1 according to the above-described embodiment and the image forming apparatus 1 according to the modification 1 in that the varying timing of the development voltage $V_{34}$ or both of the development voltage $V_{34}$ and the supply voltage $V_{35}$ may be controlled based on the exposure control signal 304A. Otherwise, the image forming apparatus 1 according to the modification 2 may include a configuration similar to that of the above-described embodiment and that of the modification 1. Accordingly, also in the modification 2, effects similar to those in the above-described embodiment and the modification 1 are obtainable.

[Modification 3]

Figure 14:
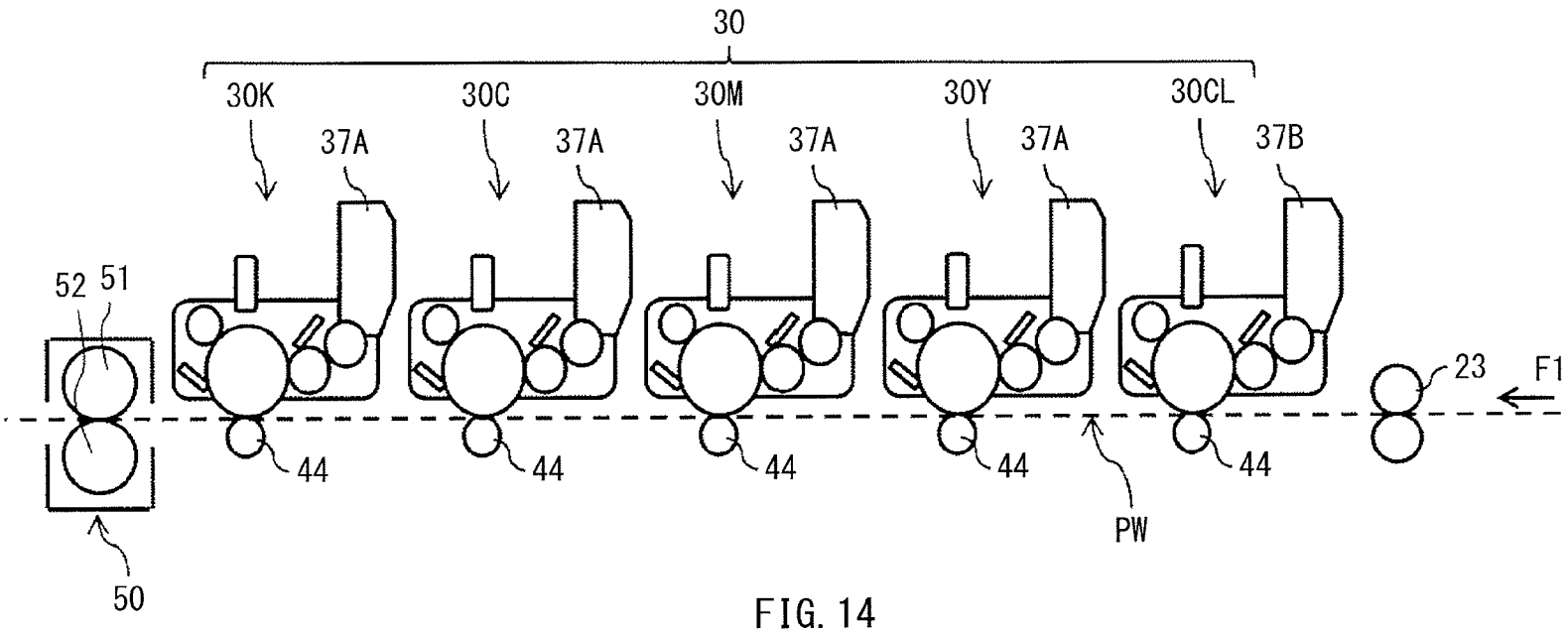
FIG. 14 is a diagram illustrating a modification of an outline configuration of an image forming section 30 and a transfer section 40 in the image forming apparatus in FIG. 1 and FIG. 13.

The indirect image transfer is employed in the above-described embodiment and the above-described modifications 1 and 2; however, direct image transfer may be employed. FIG. 14 illustrates a modification of an outline configuration of the image forming section 30 and the transfer section 40 in the image forming apparatus 1 according to any of the above-described embodiment and modifications 1 and 2. The image forming apparatus 1 according to the modification 3 is configured by omitting the transfer belt 41, the driving roller 42, the tension roller 43, the counter roller 45, the secondary transfer roller 46, and the cleaning member from the image forming apparatus 1 according any of the above-described embodiment and modifications 1 and 2, and providing a plurality of primary transfer rollers 44, for example, in a segment between the resist roller pair 23 and the fixing section 50 of the conveying path PW. In the modification 3, image forming units 30CL, 30Y, 30M, 30C, and 30K may be disposed in this order along the conveying direction F1.

In the modification 3, in the label printing mode, the high-voltage control section 303 may control the varying timing of the development voltage $V_{34}$ or both of the development voltage $V_{34}$ and the supply voltage $V_{35}$ to allow the portion P1 or both of the portions P1 and P2 to be opposed to the gap LG between labels of the medium P (rolled paper).

Figure 15A:
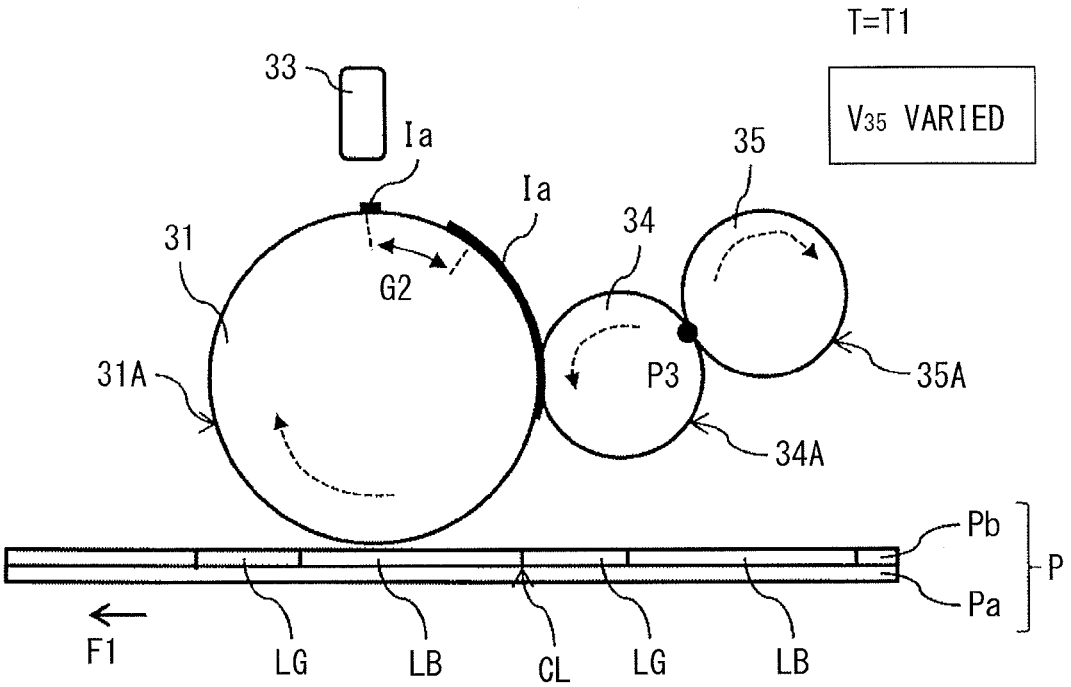
FIG. 15A is a diagram illustrating an example of operation of the image forming unit at time T=T1.
Figure 15B:
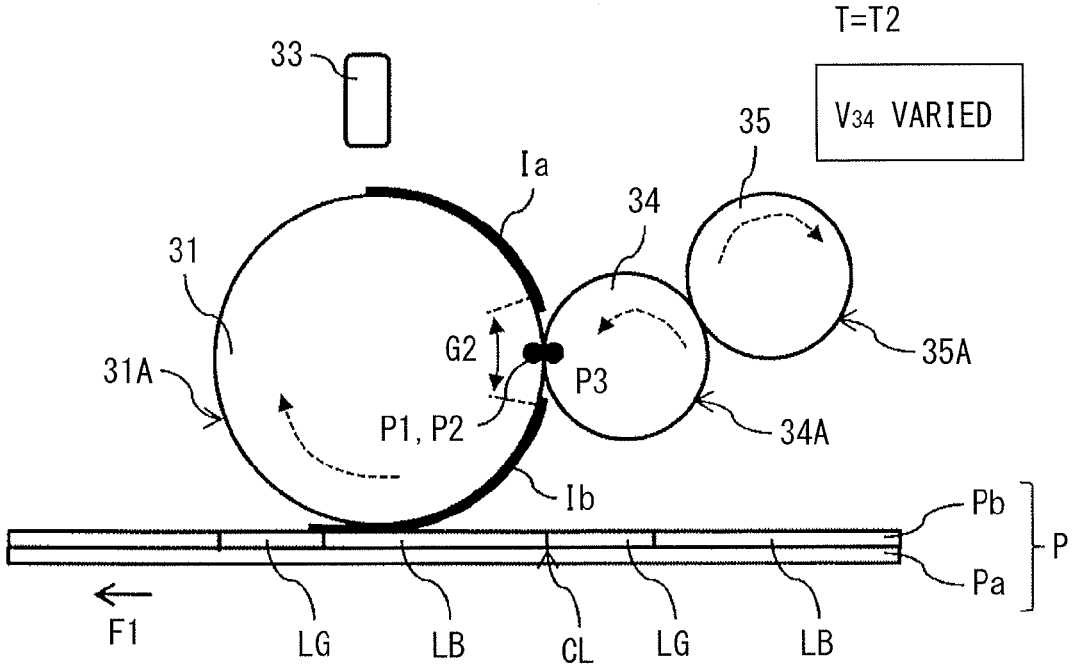
FIG. 15B is a diagram illustrating an example of the operation of the image forming unit at time T=T2.
Figure 15C:
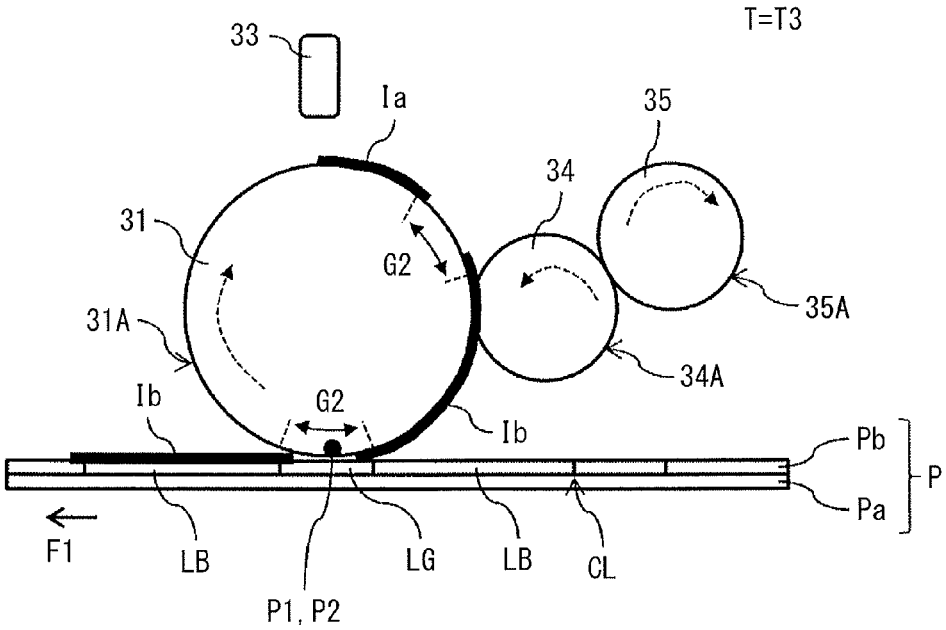
FIG. 15C is a diagram illustrating an example of the operation of the image forming unit at time T=T3.

FIG. 15A illustrates an example of the operation of the image forming unit 30Y at the time when the supply voltage $V_{35}$ is varied (time T=T1) immediately before the development voltage $V_{34}$ is varied. FIG. 15B illustrates an example of the operation of the image forming unit 30Y at the time when the development voltage $V_{34}$ is varied (time T=T2) immediately after the supply voltage $V_{35}$ is varied. FIG. 15C illustrates an example of the operation of the image forming unit 30Y immediately after the development voltage $V_{34}$ is varied (time T=T3). Note that, in the modification 3, time difference T3−T2 may correspond to a time necessary for the portion P1 to travel from a position at which the portion P1 is opposed to the circumferential surface 34A of the developing roller 34 to a position at which the portion P1 is opposed to the surface of the medium P, in the circumferential surface 31A of the photoconductive drum 31 while the photoconductive drum 31, the developing roller 34, and the feeding roller 35 rotate.

The high-voltage control section 303 may control the varying timing of the development voltage $V_{34}$ resulting from the correction of the development voltage $V_{34}$. In the label printing mode, the high-voltage control section 303 may control the varying timing of the development voltage $V_{34}$, based on the label size LS and the label gap size GS that are provided from the outside (or obtained by the detection section 80). Specifically, in the label printing mode, the high-voltage control section 303 may control the varying timing of the development voltage $V_{34}$ to allow the portion P1 to be opposed to the gap LG between labels of the medium P (rolled paper) as illustrated in FIG. 15B, FIG. 15C, and FIG. 9. The portion P1 may be a portion, in the circumferential surface 31A, opposed to the developing roller 34 upon varying of the development voltage $V_{34}$.

The high-voltage control section 303 may control the varying timing of the supply voltage $V_{35}$ resulting from the correction of the supply voltage $V_{35}$ that is performed in association with the correction of the development voltage $V_{34}$. In the label printing mode, the high-voltage control section 303 may correct the development voltage $V_{34}$ after correcting the supply voltage $V_{35}$. In the label printing mode, the high-voltage control section 303 may control the varying timing of the supply voltage $V_{35}$, based on the label size LS and the label gap size GS that are provided from the outside (or obtained by the detection section 80). Specifically, in the label printing mode, the high-voltage control section 303 may preferably control the varying timing of the supply voltage $V_{35}$ to allow the portion P2 to be opposed to the gap LG between labels of the medium P (rolled paper) as illustrated in FIG. 15A, FIG. 15B, FIG. 15C, and FIG. 9. The portion P2 may be a portion, in the circumferential surface 31A, opposed to the portion P3 of the developing roller 34. The portion P3 may be a portion, in the circumferential surface 34A of the developing roller 34, opposed to the feeding roller 35 upon varying of the supply voltage $V_{35}$.

In FIG. 15B and FIG. 15C, the high-voltage control section 303 may control the varying timing of both of the development voltage $V_{34}$ and the supply voltage $V_{35}$ to allow the portions P1 and P2 to be coincident with each other. Note that the high-voltage control section 303 may control the varying timing of both of the development voltage $V_{34}$ and the supply voltage $V_{35}$ to allow the portion P2 to be located upstream of the portion P1 in the rotation direction of the circumferential surface 31A of the photoconductive drum 31 as illustrated in FIG. 10 and FIG. 11.

In FIGS. 15A to 15C and FIGS. 9 to 11, variation in the thickness and the charged amount of the toner 37 attached on the circumferential surface 34A of the developing roller 34 resulting from varying of the supply voltage $V_{35}$ may reach the portion, in the circumferential surface 34A of the developing roller 34, opposed to the circumferential surface 31A of the photoconductive drum 31 upon or before varying of the development voltage $V_{34}$. As a result, it is possible to suppress large variation in the image density $D_I$ before and after varying of the development voltage $V_{34}$, as compared with the case where the variation in the thickness and the charged amount of the toner 37 attached on the circumferential surface 34A of the developing roller 34 resulting from varying of the supply voltage $V_{35}$ reaches the portion, in the circumferential surface 34A of the developing roller 34, opposed to the circumferential surface 31A of the photoconductive drum 31 after varying of the development voltage $V_{34}$. Note that the variation in the image density $D_I$ resulting from the varying of the supply voltage $V_{35}$ may be smaller than variation in the image density $D_I$ resulting from the varying of the development voltage $V_{34}$. Therefore, in the label printing mode, there may be a case where the portion P2 is accepted to be located at a position outside the gap G1 between the electrostatic latent images of the circumferential surface 31A.

In the modification 3, in the label printing mode, the high-voltage control section 303 may control the varying timing of the development voltage $V_{34}$ or both of the development voltage $V_{34}$ and the supply voltage $V_{35}$, based on the exposure control signal 304A generated by the exposure control section 304.

[Modification 4]

In the above-described embodiment and modifications 1 to 3, the medium P is rolled paper to which the plurality of labels LB are attached at a predetermined interval. The medium P, however, may be rolled paper in which a long seal having a size same as that of a long rolled mount is attached on a surface of the long rolled mount. In this case, there may be no cut line CL described above in the long seal.

In the modification 4, the controller 200 may transfer, as the image data Di to the exposure control section 304, the image data Di included in the print data Dp with image data of a cut line corresponding to the above-described cut line CL. The exposure control section 304 may perform data conversion of the print data including the image data Di with the image data of the cut line corresponding to the above-described cut line CL. Accordingly, in the modification 4, a cut line may be formed on outer periphery of each toner image Ib printed on the medium P.

The image forming apparatus 1 according to the modification 4 is different from the image forming apparatus 1 according to any of the above-described embodiment and modifications 1 to 3 in that the data of the cut line may be added to the image data Di. Otherwise, the image forming apparatus 1 according to the modification 4 may have a configuration similar to that of the image forming apparatus 1 according to any of the above-described embodiment and modifications 1 to 3. Therefore, also in the modification 4, effects similar to those in the above-described embodiment and modifications 1 to 3 are obtainable.

[Modification 5]

Some modifications are described below.

In the above-described embodiments, the development system using non-magnetic one-component developer is employed. In the above-described embodiment and the modifications thereof, two-component magnetic brush development system using two-component developer that includes magnetic carrier and non-magnetic toner, or one-component magnetic development system using magnetic toner may be employed. In the above-described embodiments, the image forming units 30Y, 30M, 30C, and 30K of four colors are used. Alternatively, in the above-described embodiment and the modifications thereof, for example, image forming units of three or less or five or more colors may be used. In the above-described embodiments, the LED head 33 is used. Alternatively, in the above-described embodiment and the modifications thereof, for example, a laser device may be used in place of or together with the LED head 33.

The series of processes described in the above-described embodiment and the modifications thereof may be executed by hardware (circuits) or by software (programs). In the case where the series of processes is executed by software, the software is configured of a program group causing a computer to execute each function. For example, each program may be incorporated in the above-described computer in advance or may be installed from any network or a recording medium to the above-described computer and used.

In the above-described embodiment and the modifications thereof, some embodiments of the disclosure have been described by taking a color electrophotographic printer as an example. The embodiments of disclosure are not limited to application of a color machine and a printer, and are applicable to an image forming apparatus that forms an image on a medium to be conveyed. Embodiments of the disclosure may be applicable to, for example, a monochrome copy machine, a color copy machine, a monochrome MFP, and a color MFP.

In the above-described embodiment and the modifications thereof, the image forming apparatus having a printing function has been described as a specific but non-limiting example of "image forming apparatus" in the disclosure. However, embodiments of the disclosure are not limited to application of the image forming apparatus having the printing function, and are applicable to an image forming apparatus that functions as a complex machine having, for example, a scan function and a fax function.

It is possible to achieve at least the following configurations from the above-described example embodiments of the invention.

(1) An image forming apparatus, including:

an image supporting member having a first circumferential surface that includes a photoreceptive layer;

an exposure section configured to perform exposure of the first circumferential surface and thereby form latent images;

a developer supporting member having a second circumferential surface opposed to the first circumferential surface, and configured to develop the latent images with use of a developer;

a feeding member having a third circumferential surface opposed to the second circumferential surface, and configured to feed the developer to the developer supporting member; and a control section configured to control, while controlling exposure operation of the exposure section to allow the latent images to be formed side by side at a predetermined interval on the first circumferential surface, varying timing of a development voltage or both of the development voltage and a supply voltage to allow a portion P1 or both of the portion P1 and a portion P2 to be located within a gap between the latent images on the first circumferential surface, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage.

(2) The image forming apparatus according to (1), wherein, while controlling the exposure operation, based on image data, a label size, and a label gap size that are provided from outside, the control section controls the varying timing, based on the label size and the label gap size that are provided from the outside.

(3) The image forming apparatus according to (1), further including a detection section configured to, in a label printing mode in which printing is performed on rolled paper to which a plurality of labels are attached at a predetermined interval, detect the labels on the rolled paper to derive a label size and a label gap size, wherein the control section controls the exposure operation, based on image data provided from outside and the label size and the label gap size both obtained by the detection section, and the control section controls the varying timing, based on the label size and the label gap size both obtained by the detection section.

(4) The image forming apparatus according to (1), wherein the control section controls the exposure operation and the varying timing, based on an exposure control signal adapted to control the exposure section.

(5) The image forming apparatus according to (4), wherein the control section generates the exposure control signal, based on image data, a label size, and a label gap size that are provided from outside.

(6) The image forming apparatus according to (4), further including a detection section configured to, in a label printing mode in which printing is performed on rolled paper to which a plurality of labels are attached at a predetermined interval, detect the labels on the rolled paper to derive a label size and a label gap size, wherein the control section generates the exposure control signal, based on image data provided from outside and the label size and the label gap size both obtained by the detection section.

(7) An image forming apparatus, including:

an image supporting member having a first circumferential surface that includes a photoreceptive layer;

an exposure section configured to perform exposure of the first circumferential surface and thereby form latent images;

a developer supporting member having a second circumferential surface opposed to the first circumferential surface, and configured to develop the latent images with use of a developer;

a feeding member having a third circumferential surface opposed to the second circumferential surface, and configured to feed the developer to the developer supporting member; and a control section configured to, in a label printing mode in which printing is performed on rolled paper to which a plurality of labels are attached at a predetermined interval, control varying timing of a development voltage or both of the development voltage and a supply voltage to allow a portion P1 or both of the portion P1 and a portion P2 to be opposed to a gap between the labels on the rolled paper or a portion to be opposed to the gap between the labels, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage.

(8) The image forming apparatus according to (7), wherein the control section controls the varying timing, based on a label size and a label gap size both provided from outside.

(9) The image forming apparatus according to (7), further including a detection section configured to, in the label printing mode, detect the labels on the rolled paper to derive a label size and a label gap size, wherein the control section controls the varying timing, based on the label size and the label gap size both obtained by the detection section.

(10) The image forming apparatus according to (7), wherein the control section controls the varying timing, based on an exposure control signal adapted to control the exposure section.

(11) The image forming apparatus according to (10), wherein the control section generates the exposure control signal, based on image data, a label size, and a label gap size that are provided from outside.

(12) The image forming apparatus according to (10), further including a detection section configured to, in the label printing mode, detect the labels on the rolled paper to derive a label size and a label gap size, wherein the control section generates the exposure control signal, based on image data provided from outside and the label size and the label gap size both obtained by the detection section.

As used herein, the term "oppose" and its grammatical variants are intended to encompass not only a separated state but also a contact state between one member and the other member.

It should be understood by those skilled in the art that various modifications, combinations, sub-combinations, and alterations may occur depending on design requirements and other factors insofar as they are within the scope of the appended claims or the equivalents thereof.

What is claimed is:

1. An image forming apparatus, comprising:

an image supporting member having a first circumferential surface that includes a photoreceptive layer;

an exposure section configured to perform exposure of the first circumferential surface and thereby form latent images;

a developer supporting member having a second circumferential surface opposed to the first circumferential surface, and configured to develop the latent images with use of a developer;

a feeding member having a third circumferential surface opposed to the second circumferential surface, and configured to feed the developer to the developer supporting member; and a control section configured to control, while controlling exposure operation of the exposure section to allow the latent images to be formed side by side at a predetermined interval on the first circumferential surface, varying timing of a development voltage or both of the development voltage and a supply voltage to allow a portion P1 or both of the portion P1 and a portion P2 to be located within a gap between the latent images on the first circumferential surface, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage.

2. The image forming apparatus according to claim 1, wherein, while controlling the exposure operation, based on image data, a label size, and a label gap size that are provided from outside, the control section controls the varying timing, based on the label size and the label gap size that are provided from the outside.

3. The image forming apparatus according to claim 1, further comprising a detection section configured to, in a label printing mode in which printing is performed on rolled paper to which a plurality of labels are attached at a predetermined interval, detect the labels on the rolled paper to derive a label size and a label gap size, wherein the control section controls the exposure operation, based on image data provided from outside and the label size and the label gap size both obtained by the detection section, and the control section controls the varying timing, based on the label size and the label gap size both obtained by the detection section.

4. The image forming apparatus according to claim 1, wherein the control section controls the exposure operation and the varying timing, based on an exposure control signal adapted to control the exposure section.

5. The image forming apparatus according to claim 4, wherein the control section generates the exposure control signal, based on image data, a label size, and a label gap size that are provided from outside.

6. The image forming apparatus according to claim 4, further comprising a detection section configured to, in a label printing mode in which printing is performed on rolled paper to which a plurality of labels are attached at a predetermined interval, detect the labels on the rolled paper to derive a label size and a label gap size, wherein the control section generates the exposure control signal, based on image data provided from outside and the label size and the label gap size both obtained by the detection section.

7. An image forming apparatus, comprising:

an image supporting member having a first circumferential surface that includes a photoreceptive layer;

an exposure section configured to perform exposure of the first circumferential surface and thereby form latent images;

a developer supporting member having a second circumferential surface opposed to the first circumferential surface, and configured to develop the latent images with use of a developer;

a feeding member having a third circumferential surface opposed to the second circumferential surface, and configured to feed the developer to the developer supporting member; and a control section configured to, in a label printing mode in which printing is performed on rolled paper to which a plurality of labels are attached at a predetermined interval, control varying timing of a development voltage or both of the development voltage and a supply voltage to allow a portion P1 or both of the portion P1 and a portion P2 to be opposed to a gap between the labels on the rolled paper or a portion to be opposed to the gap between the labels, the portion P1 being a portion, in the first circumferential surface, opposed to the developer supporting member upon varying of the development voltage, the portion P2 being a portion, in the first circumferential surface, opposed to a portion P3 of the developer supporting member, and the portion P3 being a portion, in the second circumferential surface, opposed to the feeding member upon varying of the supply voltage.

8. The image forming apparatus according to claim 7, wherein the control section controls the varying timing, based on a label size and a label gap size both provided from outside.

9. The image forming apparatus according to claim 7, further comprising a detection section configured to, in the label printing mode, detect the labels on the rolled paper to derive a label size and a label gap size, wherein the control section controls the varying timing, based on the label size and the label gap size both obtained by the detection section.

10. The image forming apparatus according to claim 7, wherein the control section controls the varying timing, based on an exposure control signal adapted to control the exposure section.

11. The image forming apparatus according to claim 10, wherein the control section generates the exposure control signal, based on image data, a label size, and a label gap size that are provided from outside.

12. The image forming apparatus according to claim 10, further comprising a detection section configured to, in the label printing mode, detect the labels on the rolled paper to derive a label size and a label gap size, wherein the control section generates the exposure control signal, based on image data provided from outside and the label size and the label gap size both obtained by the detection section.

* * * * *